US006149480A

United States Patent [19]

Iwasaki et al.

[11] Patent Number: 6,149,480

[45] Date of Patent: Nov. 21, 2000

[54] IMAGE FORMING DEVICE FABRICATION METHOD AND FABRICATION APPARATUS

[75] Inventors: Tatsuya Iwasaki, Machida; Izumi Tabata, Yokohama, both of Japan

[73] Assignee: Canon Kabushiki Kaisha, Tokyo, Japan

[21] Appl. No.: 09/255,841

[22] Filed: Feb. 23, 1999

[30] Foreign Application Priority Data

Feb. 24, 1998 [JP] Japan ..... 10-042187
Feb. 18, 1999 [JP] Japan ..... 11-040382

[51] Int. Cl.[7] ..... H01J 9/42; H01J 9/39

[52] U.S. Cl. ..... 445/6; 445/3

[58] Field of Search ..... 445/3, 6, 24, 63, 445/72

[56] References Cited

U.S. PATENT DOCUMENTS 5,066,883 11/1991 Yoshioka et al. ..... 313/309
5,591,061 1/1997 Ikeda et al. ..... 445/6
5,658,180 8/1997 Takagi ..... 445/6

FOREIGN PATENT DOCUMENTS 1-031332 2/1989 Japan .
1-217831 8/1989 Japan .
1-283749 11/1989 Japan .
2-257552 10/1990 Japan .
2-299129 12/1990 Japan .
9-213224 8/1997 Japan .

OTHER PUBLICATIONS

Dyke, W.P., et al., "Field Emission," Advances in Electronics and Electron Physics, New York: Academic Press, Inc. (1956), pp. 89–185.

Elinson, M.I., et al., "The Emission of Hot Electrons and the Field Emission of Electrons from Tin Oxide," Radio Engineering and Electronic Phys., No. 7 (1965), pp. 1290–1296.

Mead, C.A., "Operation of Tunnel–Emission Devices," Journal of Applied Physics, vol. 32, No. 4 (1961), pp. 646–652.

Dittmer, G., "Electrical Conduction and Electron Emission of Discontinuous Thin Films," Thin Solid Films, vol. 9 (1972), pp. 317–328.

Hartwell, M., et al., "Strong Electron Emission from Patterned Tin–Indium Oxide Thin Films," International Electron Devices Meeting (1975), pp. 519–521.

Spindt, C.A., et al., "Physical Properties of Thin–Film Field Emission Cathodes with Molybdenum Cones," Journal of Applied Physics, vol. 47, No. 12 (1976), pp. 5248–5263.

Araki, H., et al., "Electroforming and Electron Emission of Carbon Thin Films," Journal of the Vacuum Society of Japan, vol. 26, No. 1 (1983), pp. 22–29.

*Primary Examiner*—Kenneth J. Ramsey
*Attorney, Agent, or Firm*—Fitzpatrick, Cella, Harper & Scinto

[57] ABSTRACT

There are provided a highly reliable fabrication method and apparatus for an image forming device which can avoid element deterioration along with elimination of gas molecules from panel constituents.

An image forming device having an electron source substrate with a large number of electron sources each having an electron-emitting element and a luminescent display plate facing the electron source substrate via a vacuum portion is fabricated by performing the aging step of aging the interior of the vacuum portion while exhausting or maintaining with a getter the vacuum state of the vacuum portion. This aging step is performed by drive duty control of gradually increasing the drive duty of the image forming device.

16 Claims, 26 Drawing Sheets

CONTROL OUTPUT

- ANODE VOLTAGE Va
- ELECTRON SOURCE DRIVE CONDITIONS
  - DRIVE VOLTAGE
  - DRIVE DUTY
  - DRIVE ELEMENT NUMBER
  - DRIVE SCAN FREQ.
- GRID VOLTAGE
- DISPLAY IMAGE PATTERN
- ⋮

$= f$

INFORMATION INPUT

- VACUUM INFORMATION
  - ·WHOLE PRESSURE
  - ·PARTIAL PRESSURE ($H_2O$, $O_2$···)
- ELECTRON SOURCE DRIVE CURRENT
- LUMINESCENT DISPLAY CURRENT
- DISPLAY IMAGE
- ⋮

IMAGE FORMING DEVICE FABRICATION METHOD AND FABRICATION APPARATUS

BACKGROUND OF THE INVENTION

1. Field of the Invention

The present invention relates to an image forming device fabrication method and fabrication apparatus using a (surface-conduction type) electron-emitting element.

2. Related Background Art

Conventionally, electron-emitting elements are mainly classified into two types of elements: thermionic and cold cathode electron-emitting elements. Known examples of the cold cathode electron-emitting elements are field emission type electron-emitting elements (to be referred to as FE type electron-emitting elements hereinafter), metal/insulator/metal type electron-emitting elements (to be referred to as MIM type electron-emitting elements hereinafter), and surface-conduction type electron-emitting elements.

Known examples of the FE type electron-emitting elements are disclosed in W. P. Dyke and W. W. Dolan, "Field Emission", Advance in Electron Physics, 8, 89 (1956) and C. A. Spindt, "Physical Properties of Thin-Film Field Emission Cathodes with Molybdenium Cones", J. Appl. Phys., 47, 5248 (1976). A known example of the MIM type electron-emitting elements is disclosed in C. A. Mead, "Operation of Tunnel-Emission Devices", J. Appl. Phys., 32,646 (1961). A known example of the surface-conduction type electron-emitting elements is disclosed in, e.g., M. I. Elinson, Radio Eng. Electron Phys., 10, 1290 (1965).

The surface-conduction type electron-emitting element utilizes the phenomenon that electrons are emitted from a small-area thin film formed on a substrate by flowing a current parallel through the film surface. The surface-conduction type electron-emitting element includes electron-emitting elements using an $SnO_2$ thin film according to Elinson mentioned above [M. I. Elinson, Radio Eng. Electron Phys., 10, 1290, (1965)], an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like.

Since the surface-conduction type electron-emitting elements have a simple structure and can be easily fabricated, many elements can be formed on a wide area. Various applications using this feature have been studied. For example, surface-conduction type electron-emitting elements are applied to charged beam sources, display devices, and the like. An example using a large number of surface-conduction type electron-emitting elements is an electron source formed by arranging many rows prepared by arranging surface-conduction type electron-emitting elements parallel and connecting them at the two terminals of each element with a wiring line (to be also referred to as a common wiring line) (e.g., Japanese Patent Application Laid-Open Nos. 64-031332, 1-283749, and 2-257552).

On the other hand, flat display devices using liquid crystals have recently replacing CRTs in image forming devices such as display devices. The flat display devices undesirably require a backlight because they are not of a self-emission type. Demands arise for development of self-emission type display devices. An example of the self-emission type display devices is an image forming device as a display device using a combination of an electron source formed by arranging a large number of surface-conduction type electron-emitting elements and a fluorescent substance which emits visible light upon reception of electrons emitted by the electron source (e.g., U.S. Pat. No. 5,066,883).

FIG. 28 shows an example of a method of fabricating a conventional flat image forming device. After an electron source substrate and luminescent display plate are formed, an area defined between the electron source substrate and luminescent display plate is evacuated upon an assembling step. If necessary, baking is done as a degassing step, and sealing and getter flash steps are done to fabricate an image forming device.

SUMMARY OF THE INVENTION

In this flat image forming device, the electron source substrate having a plurality of electron-emitting elements and the luminescent display plate having a fluorescent substance and the like face each other via the vacuum portion. The image forming device emits electrons from each electron-emitting element by applying scan and modulation signals to the electron source substrate, and accelerates the electrons by an anode voltage Va of several kV or more applied to the luminescent display plate to collide them against the fluorescent substances and emit light, thereby displaying an image.

However, the flat display device suffers a serious decrease in luminance and point and line defects on the display generated in the initial stage of operation. One of the causes of a decrease in luminance and generation of defects is deterioration of the characteristics of the electron-emitting element resulting from vacuum degradation by gas generation (degassing) along with operation caused by elimination of gas molecules from panel constituents such as a fluorescent substance and metal back formed on the luminescent display plate, and a wiring line, electrode, and electron-emitting element formed on the electron source substrate.

As a measure against vacuum degradation, "to enhance the vacuum exhaustibility" and "to reduce the degassing amount from each panel constituent" are conceivable.

As the former measure, a sufficient amount of getter is sealed. A conventional display device such as a CRT which is evacuated can maintain satisfactory vacuum by a getter. However, the flat display device cannot be satisfactorily evacuated against particularly local degassing in the display device because the capacity of the vacuum portion in the display device is small and the exhaustion conductance from a getter is small.

As the latter measure, the degassing amount from a panel constituent is reduced by a high-temperature vacuum exhaustion/baking process. However, the degassing amount cannot be sufficiently reduced by general backing at several hundred ° C., and the above problem cannot be essentially solved. In addition, high-temperature baking makes it impossible to use, as members for the display device, members which cannot stand high-temperature exhaustion baking, i.e., members which cause chemical reaction, alloying, and coagulation of thin films, and a combination of these members. This greatly limits the structure of the display device.

Control of degassing from panel constituents such as wiring lines, electrodes, and electron-emitting elements includes a method of gradually increasing the anode voltage applied to the luminescent display plate, and a method of controlling the vacuum atmosphere in the image forming device by gradually increasing the electron source drive voltage (e.g., Japanese Patent Application Laid-Open No. 9-213224). It is, however, desirable to more finely control the degassing amount generated in the image forming device.

The present invention has been made in consideration of the above situations, and has as its object to provide a fabrication method and fabrication apparatus for an image forming device with high reliability for avoiding element deterioration along with elimination of gas molecules from panel constituents.

More specifically, according to the present invention, there is provided a method of fabricating an image forming device having an electron source substrate with a large number of electron sources each having an electron-emitting element and a luminescent display plate facing the electron source substrate via a vacuum portion, comprising the aging step of aging an interior of the vacuum portion while exhausting or maintaining with a getter a vacuum state of the vacuum portion, the aging step being performed by drive duty control of gradually increasing a drive duty of the image forming device.

Aging by drive duty control can be more reliably attained by monitoring the vacuum state in the vacuum portion with a vacuum gauge and feeding back information about the obtained vacuum degree. For this purpose, according to the present invention, there is provided an apparatus for fabricating an image forming device having an electron source substrate with a large number of electron-emitting elements and a luminescent display plate facing the electron source substrate via a vacuum portion, comprising exhaustion means for evacuating the vacuum portion, a vacuum gauge for measuring a vacuum degree in the vacuum portion, an electron source drive device for driving the electron source, and an anode power source used to accelerate an electron beam from the electron-emitting element.

According to the present invention, since the aging step is employed in the image forming device fabrication process, element deterioration and vacuum discharge along with elimination of gas molecules from constituents can be suppressed to suppress or reduce generation of point and line defects and the like, and to increase the yield. Since deterioration in the initial stage of operation can be suppressed, a high-luminance image forming device capable of stable display can be realized. The present invention can achieve the above effects without particularly performing any vacuum baking process at high temperatures.

According to the image forming device fabrication method of the present invention, after an electron source substrate and luminescent display plate are formed and assembled, a degassing step called an "aging step" is done subsequent to exhaustion for vacuum, baking, sealing, and getter flash, as shown in FIG. 22. This degassing step is executed by control of gradually increasing the drive duty. When a surface-conduction type electron-emitting element is used as an electron-emitting element on the electron source substrate, forming, activation, stabilization, and the like are properly done, as shown in FIG. 23. The aging step is done after the sealing step in FIGS. 22 and 23, but sealing may be done after aging.

As described above, the image forming device operates to generate a considerable amount of gas due to degassing from panel constituents along with irradiation of an electron beam and heat. If an excessive amount of gas is generated to greatly decrease the vacuum degree, the characteristics of the electron-emitting element deteriorate to decrease the luminance and cause point and line defects on the display.

The present inventor has extensively studied to find that the degassing amount in operation changes depending on the arrangement of the image forming device and steps before aging, and the change has the following features:

(Feature (1))

The degassing amount tends to qualitatively increase when a factor which can determine the drive duty, such as a drive voltage Vf, drive pulse width, or the number of drive elements increases, as shown in FIG. 24.

(Feature (2))

The degassing amount tends to increase in the initial stage of operation and decrease with the operation time when the image forming device continuously operates under the same conditions, as shown in FIG. 25.

The former indicates that the degassing amount depends on an electron amount emitted by the electron source per unit time or an electron amount incident on the luminescent display plate. The latter indicates that the total degassing amount is limited, and that the following degassing step can be performed to provide an image forming device whose degassing amount becomes sufficiently small at last.

Considering these features, in the present invention, the aging step is done by drive duty control of increasing the drive duty with the lapse of time while the image forming device is evacuated by an exhaust device or the getter disposed in the image forming device exhibits exhaustibility.

The drive duty is an operation condition of the image forming device that contributes to an electron amount emitted by the electron source per unit time or an electron amount incident to the luminescent display plate, as mentioned in feature (1). That is, a large drive duty means that at least one of the drive pulse, drive frequency, and the number of drive elements is high or large. In addition to these conditions, the drive duty control can employ an operation of increasing at least one of an anode voltage Va, drive voltage Vf, and grid voltage. Note that when the vacuum portion is monitored by a vacuum gauge, at least one of the anode voltage Va, drive voltage Vf, grid voltage, drive pulse, drive frequency, and the number of drive elements can be selected to control the drive duty.

"To increase the drive duty with the lapse of time" can be attained by only controlling the drive duty to become larger over a long time. Hence, the drive duty may be temporarily controlled to decrease within a short time, or aging may be temporarily stopped.

Operation of the aging method will be explained with reference to FIGS. 29A to 29C and 30A to 30C. Conventionally, as shown in FIGS. 29A to 29C, large-drive-duty operation is performed from the initial stage of operation (FIG. 29A), the vacuum degree greatly decreases (FIG. 29B), and vacuum discharge occurs to deteriorate the electron-emitting element (FIG. 29C). According to the aging method of the present invention, as shown in FIGS. 30A to 30C (e.g., FIG. 30B), operation starts under initial operation conditions with a small drive duty, i.e., small degassing amount. As the degassing amount decreases with the lapse of time, the operation conditions are controlled/changed to large-drive-duty operation conditions. As a result, a great decrease in vacuum degree can be avoided, and the image forming device can reach normal operation at last. In other words, the controlled degassing method in the aging step of the present invention can be adopted to prompt satisfactory degassing from each constituent and allow the image forming device to reach normal operation while suppressing or avoiding a great decrease in vacuum degree which may deteriorate the electron-emitting element or cause vacuum discharge.

As will be described in detail later, if the vacuum degree of the vacuum portion in the image forming device is detected by the vacuum gauge and the operation conditions of the image forming device are controlled based on the vacuum degree, the aging step can attain high reliability and be completed within a relatively short time. This aging step allows the display device capable of final normal operation to stably display an image even in subsequent steady driving.

Note that the aging method of the present invention can be applied to image forming devices using FE and MIM type electron-emitting elements in addition to surface-conduction type electron-emitting elements.

BRIEF DESCRIPTION OF THE DRAWINGS

FIGS. 1A and 1B are schematic views showing a flat surface-conduction type electron-emitting element (surface-conduction type electron-emitting element) used in the present invention, in which FIG. 1A is a plan view, and FIG. 1B is a sectional view taken along a direction perpendicular to the element electrode alignment direction;

DETAILED DESCRIPTION OF THE PREFERRED EMBODIMENTS

An "aging step", as a characteristic step of the image forming device fabrication method of the present invention, will be first described in detail. Then, the structure, fabrication method, and characteristics of a surface-conduction type electron-emitting element applicable to the image forming device of the present invention will be described. Further, the arrangement and fabrication method of an image forming device according to the present invention will be explained.

(Aging Step)

Figure 22:
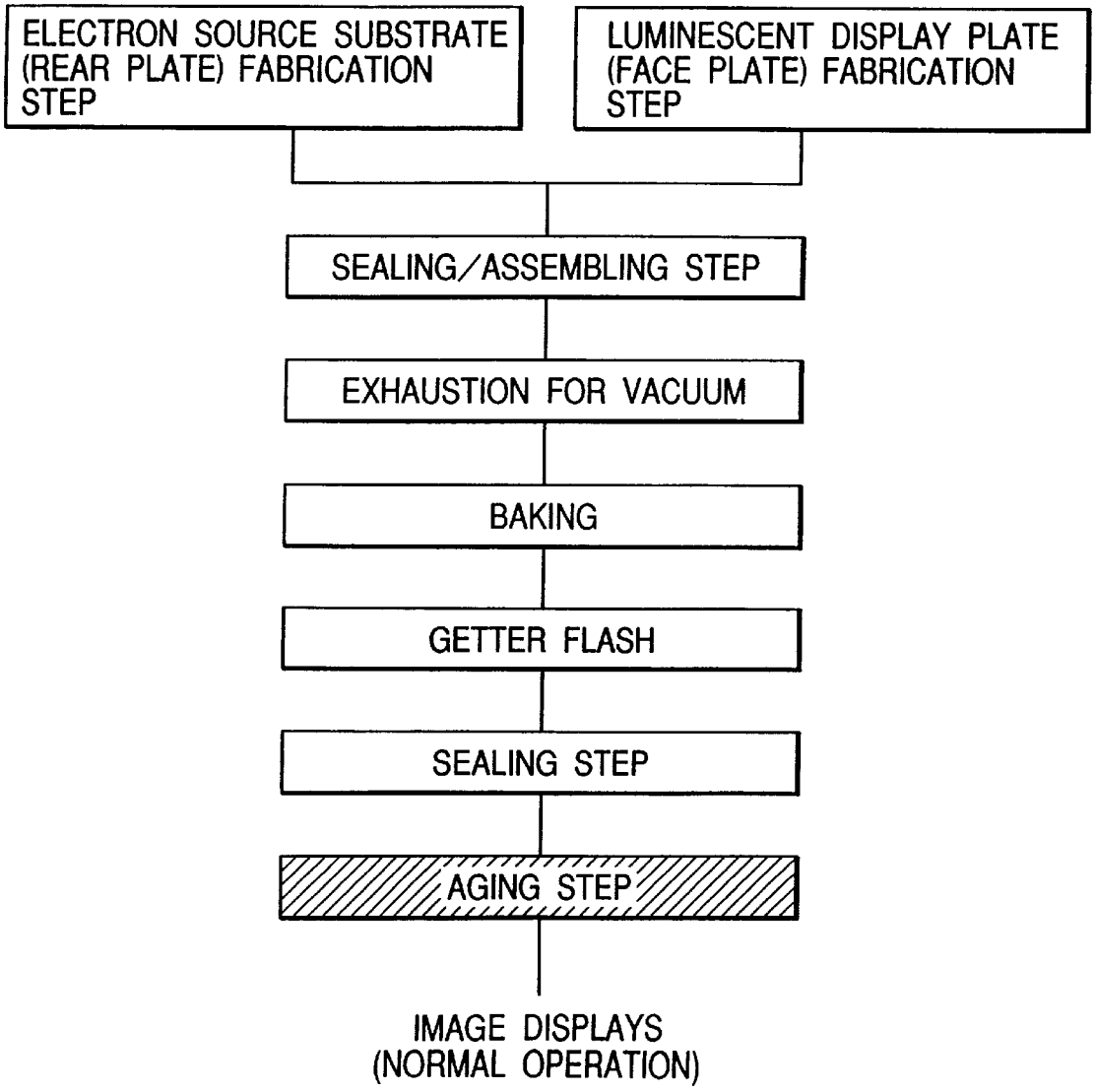
FIG. 22 is a flow chart showing an image forming device fabrication process.
Figure 23:
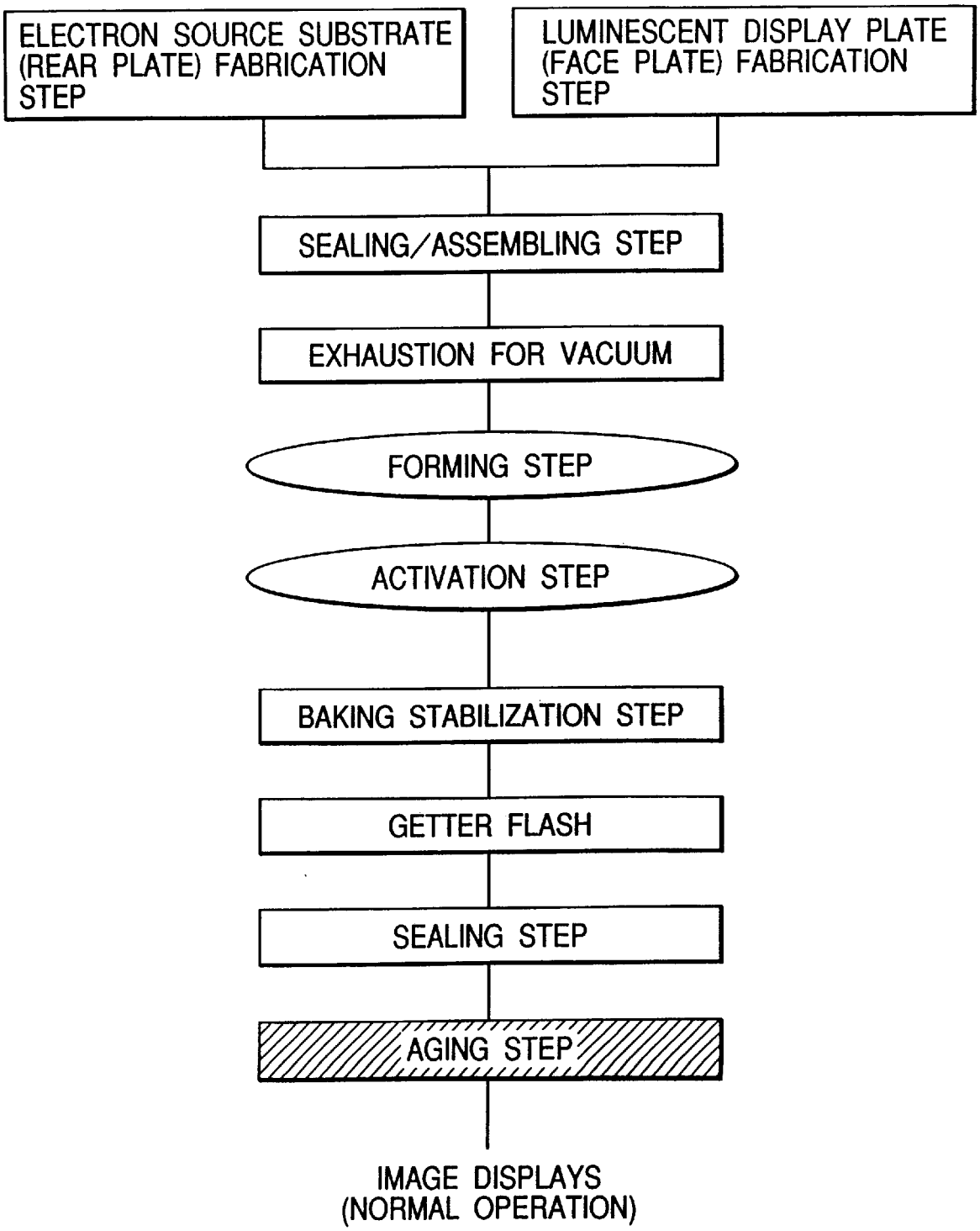
FIG. 23 is a flow chart showing another image forming device fabrication process.
Figure 24A:
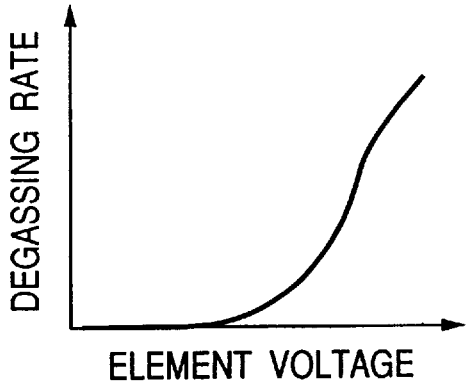
FIGS. 24A, 24B, and 24C are graphs each showing an example of the relationship between the operation condition and degassing rate in the image forming device.
Figure 24B:
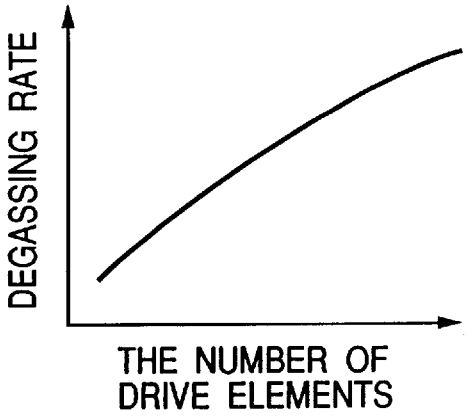
Figure 24C:
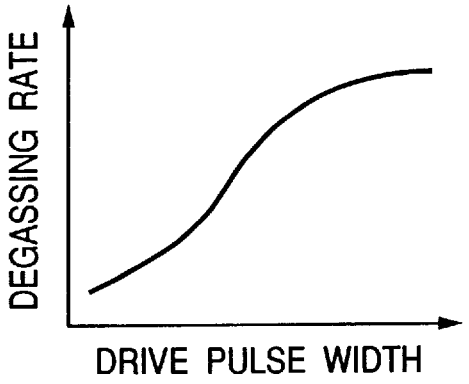
Figure 25:
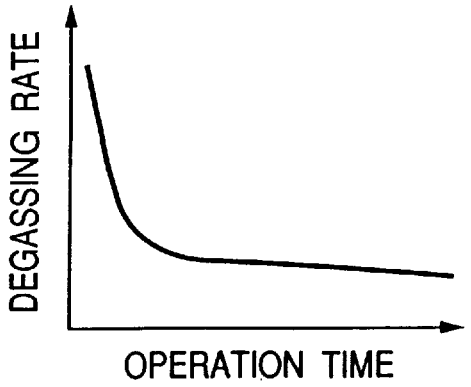
FIG. 25 is a graph showing the operation time vs. degassing rate in the image forming device.

As shown in FIGS. 22 and 23, an aging step is performed prior to normal operation of the image forming device (i.e., operation when the image forming device is actually used in accordance with the application purpose, e.g., 60-Hz TV operation at the anode voltage Va=about 10 kV or full-surface ON operation) after an electron source substrate and luminescent display plate are formed, assembled, evacuated, baked, sealed, and subjected to getter flash and the like.

(Aging Apparatus)

Figure 19:
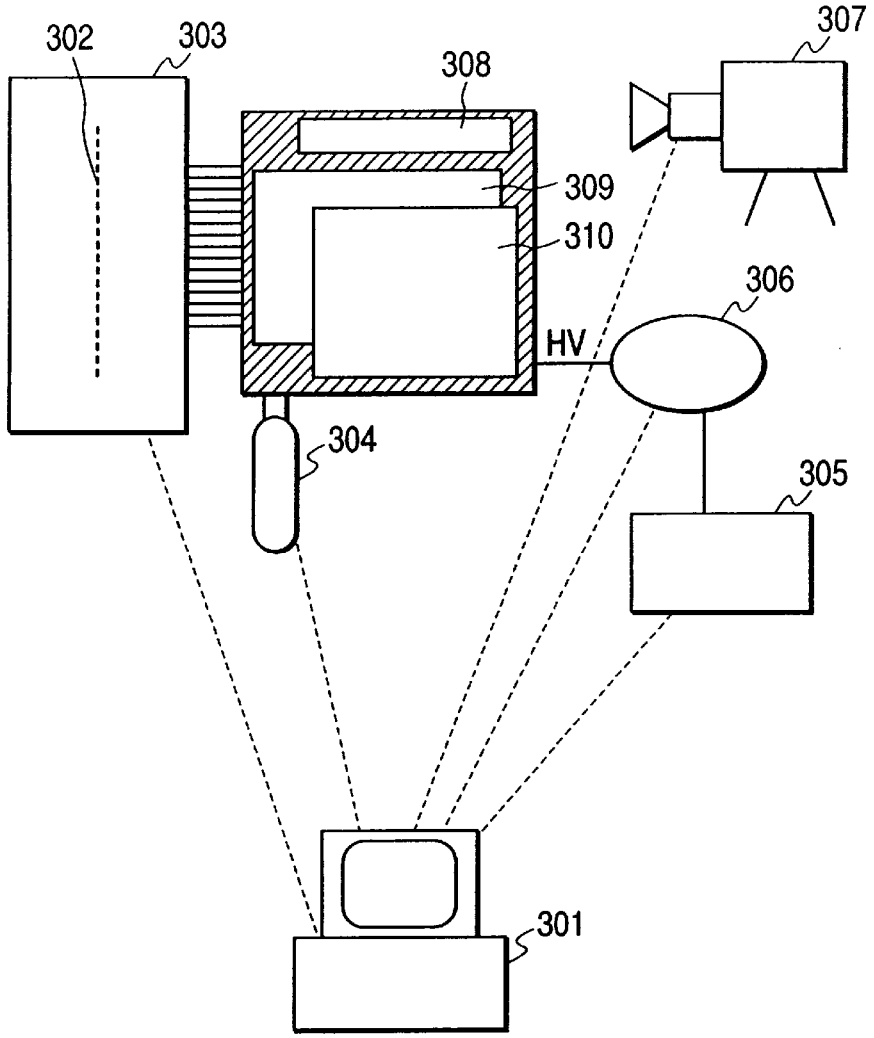
FIG. 19 is a view showing an aging method and apparatus according to the present invention.

An aging method and image forming device fabrication apparatus (aging apparatus) according to the present invention will be described with reference to FIG. 19. FIG. 19 is a schematic view showing an example of the aging apparatus. An image forming device 308 under fabrication is constituted by an electron source substrate 309 having a plurality of electron-emitting elements and a luminescent display plate 310 facing the electron source substrate via a vacuum portion. The vacuum portion of the image forming device 308 is connected to a vacuum gauge 304. The electron source substrate 309 and luminescent display plate 310 are respectively connected to an electron source drive device 302 and a high-voltage source (anode voltage source) 305 for accelerating an electron beam.

The vacuum gauge 304 is a whole or partial pressure gauge for extracting vacuum information of the vacuum portion in the image forming device. As the partial pressure gauge, an ion gauge, quadruple-pole mass spectrum meter, and the like can be used. The electron source drive device 302 applies a desired element voltage to electron-emitting elements arranged on the electron source substrate, and can arbitrarily set factors which can determine the drive duty, such as the drive voltage Vf, drive frequency, and the number of drive elements. The electron source drive device 302 can have the same structure as a TV drive device (to be described later), and can be driven by an arbitrary image test pattern such as a staggered or monochrome display. The drive scan frequency is the frequency of one period for driving while sequentially switching drive lines. The number of drive elements is the number of drive lines, the area of a partial display, an interlaced display (lines not to be driven are arranged every several lines), and the like. The high-voltage source (anode voltage source) 305 applies an anode voltage to the luminescent display plate.

The aging apparatus can further comprise an electron source drive current measurement device 303 for measuring a current (mainly an element current) flowing through the electron source substrate along with the driving of the electron source, a luminescent display current measurement device 306 for measuring a current (mainly an emission current) flowing between the electron source substrate and luminescent display plate, a display image analyzer 307 for sensing and analyzing an image displayed during aging, and the like.

These devices can be concentratedly managed/controlled by a computer 301. The control can adopt arbitrary control logic such as PID control.

(Aging Method)

An aging method using the aging apparatus will be explained in detail. In the aging step, the drive duty is increased with the lapse of time while performing exhaustion for vacuum. More specifically, to increase the drive duty, at least one of the electron source drive pulse width, drive frequency, the number of drive elements, and the like is increased. If necessary, at least one selected from the anode voltage Va, drive voltage Vf, grid voltage Vg, and the like may be additionally increased. In monitoring with the vacuum gauge, the drive duty can be increased using at least one of these requirements. Of these conditions, the drive pulse width and drive scan frequency are more preferable because they can uniformly control degassing generated in the panel over the entire panel surface.

Aging conditions used in this aging method change depending on a panel arrangement, fabrication method, and the like. These conditions can be set based on past data, designs and simulations conducted in consideration of the fact that the degassing amount in operation changes with the above-described features (1) and (2), and the like. For example, aging conditions include a condition "to increase the drive pulse width to 1 to $Pw_{max}$ $\mu$s" (note that the maximum pulse width $Pw_{max}$ can be represented by the number of scan lines/period=16.6 ms of the image display drive frequency), or a condition "to increase the drive frequency to 1 Hz to 60 Hz at 1 Hz/min".

Figure 30A:
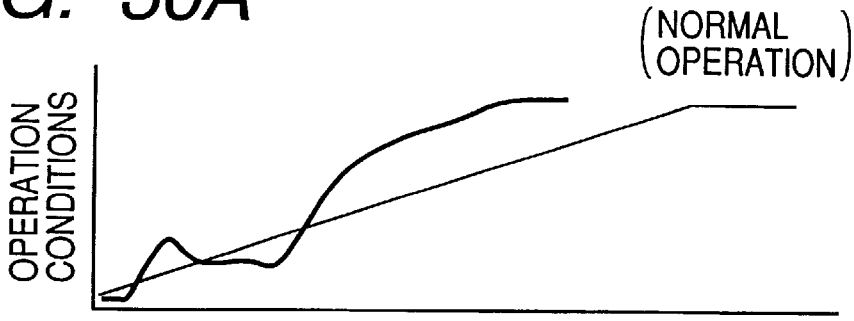
FIGS. 30A, 30B, and 30C are graphs showing vacuum discharge and electron source deterioration which can be suppressed by avoiding a decrease in vacuum degree by the aging step of the present invention.
Figure 30B:
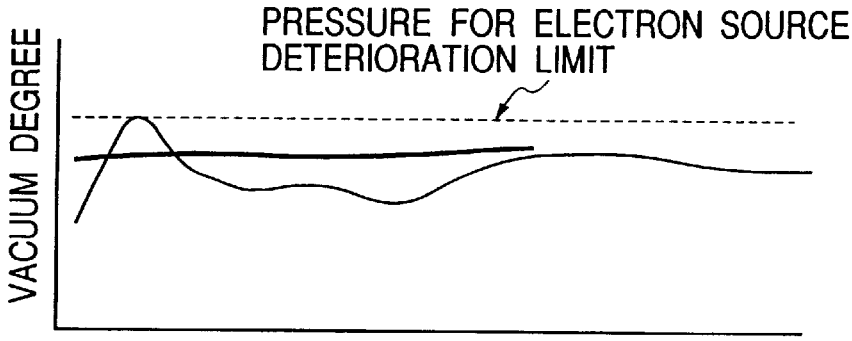
Figure 30C:
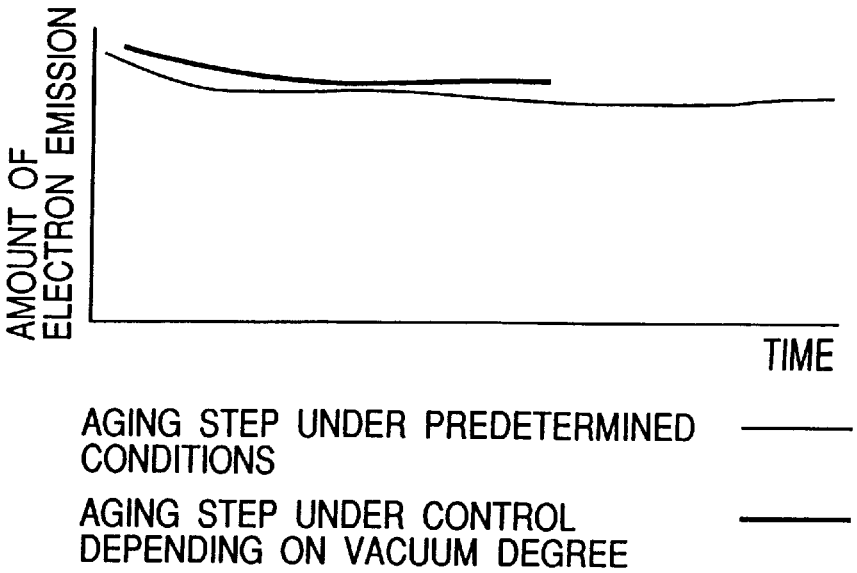

Examples of changes over time in degassing or electron emission amount in this aging step are represented by thin lines in FIGS. 30A to 30C. According to this method, as shown in FIGS. 30A to 30C, small-power-consumption operation is properly done in the initial stage of operation to prompt satisfactory degassing from each constituent by heat and electron beam energy. Therefore, the image forming device can reach normal operation while suppressing or avoiding a great decrease in vacuum degree which may deteriorate the electron-emitting element or cause vacuum discharge.

(Vacuum Monitoring Aging)

Although the degassing amount in operation can be estimated to a certain degree, all uncertainties cannot be eliminated. In the aging process, the vacuum degree of the vacuum portion of the image forming device 308 is preferably measured with operation to control/change (feedback-control) operation conditions based on this vacuum degree.

A method of controlling operation conditions based on the vacuum degree complies with, e.g., control logic A or B.

[Control Logic A]

When the vacuum degree is detected to be sufficiently high, operation conditions are changed to increase at least one of the electron source drive pulse width, drive voltage, drive frequency, and the number of drive elements.

[Control Logic B]

When the vacuum degree is detected to be low, operation conditions are changed to decrease at least one of the electron source drive pulse width, drive voltage, drive frequency, and the number of drive elements.

Instead of [Control Logic B], the control method can adopt

[Control Logic B']

When the vacuum degree is detected to be low, drive conditions are maintained without any change. According to this method (to be referred to as vacuum monitoring aging), the vacuum degree can be kept constant, as represented by thick lines in FIGS. 30A to 30C, and a degassing step with higher reliability can be attained within a short time.

Figure 20:
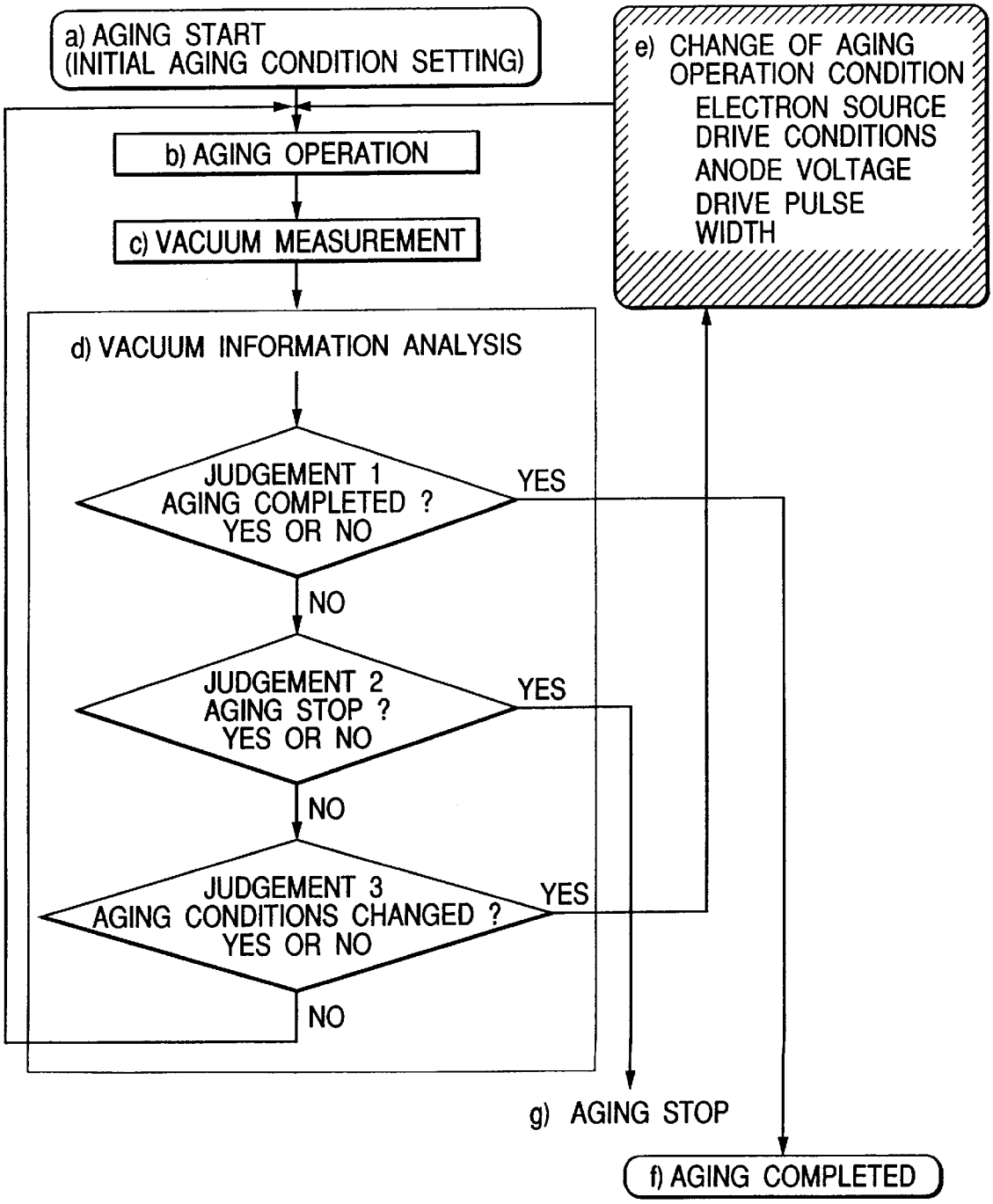
FIG. 20 is a flow chart showing a control method in the aging step of the present invention.

A general vacuum monitoring aging control method will be described in more detail with reference to the flow chart in FIG. 20. a) Initial conditions for operation of the image forming device are set at the start of aging. Initial conditions are not particularly limited as far as the degassing amount becomes sufficiently small. After b) operation starts under the initial conditions, c) vacuum information is sequentially measured, and d) & e) the drive conditions are changed based on the control logics A and B in accordance with the vacuum information. b) to e) are repeatedly executed as a control loop until, for example, judgement criteria 1 and 2 (to be described below) are satisfied. In this case, vacuum information are whole and partial pressures.

Figure 26:
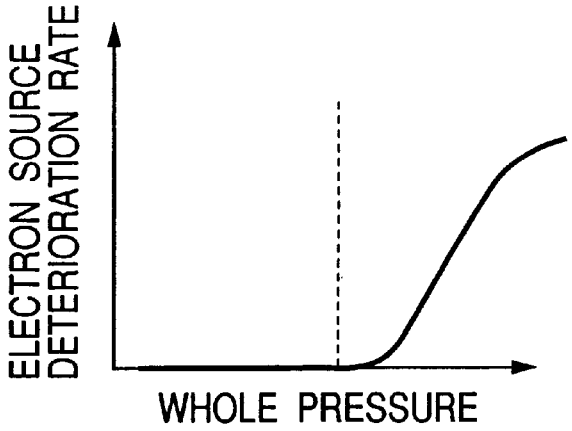
FIG. 26 is a graph showing an example of the vacuum degree vs. electron source deterioration rate.

In general, when the whole pressure is high, the electron source deterioration rate is high, as shown in FIG. 26. Considering this, operation conditions are desirably controlled using a defined whole pressure as a reference on the basis of the following control logics so as not to exceed this pressure.

[Control Logic A-1]

When the whole pressure is equal to or lower than the defined whole pressure, drive conditions, i.e., at least one of the electron source drive pulse width, drive voltage, drive frequency, and the number of drive elements is increased.

[Control Logic B-1]

When the whole pressure is equal to or higher than the defined whole pressure, drive conditions, i.e., at least one of the electron source drive pulse width, drive voltage, drive frequency, and the number of drive elements is decreased.

[Control Logic B-1] may be replaced with

[Control Logic B'-1]

When the whole pressure is equal to or higher than the defined whole pressure, drive conditions are maintained. The defined whole pressure is appropriately set to, e.g., $10^{-6}$ Torr or less and desirably to $10^{-8}$ Torr or less in accordance with the panel structure such as the distance between the electron source substrate and luminescent display plate.

Figure 27A:
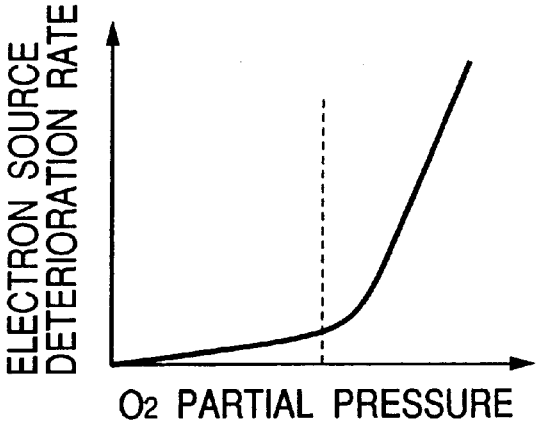
FIGS. 27A and 27B are graphs each showing an example of the vacuum degree vs. electron source curve.
Figure 27B:
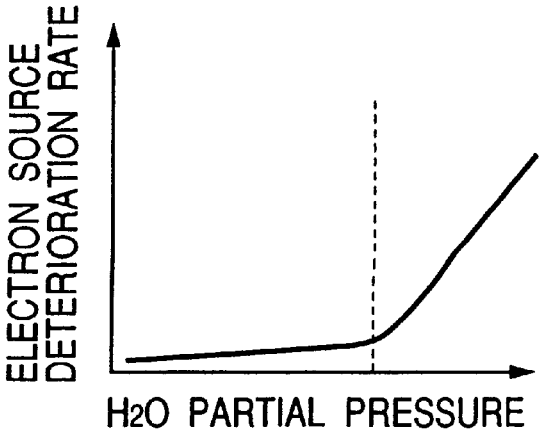
Figure 28:
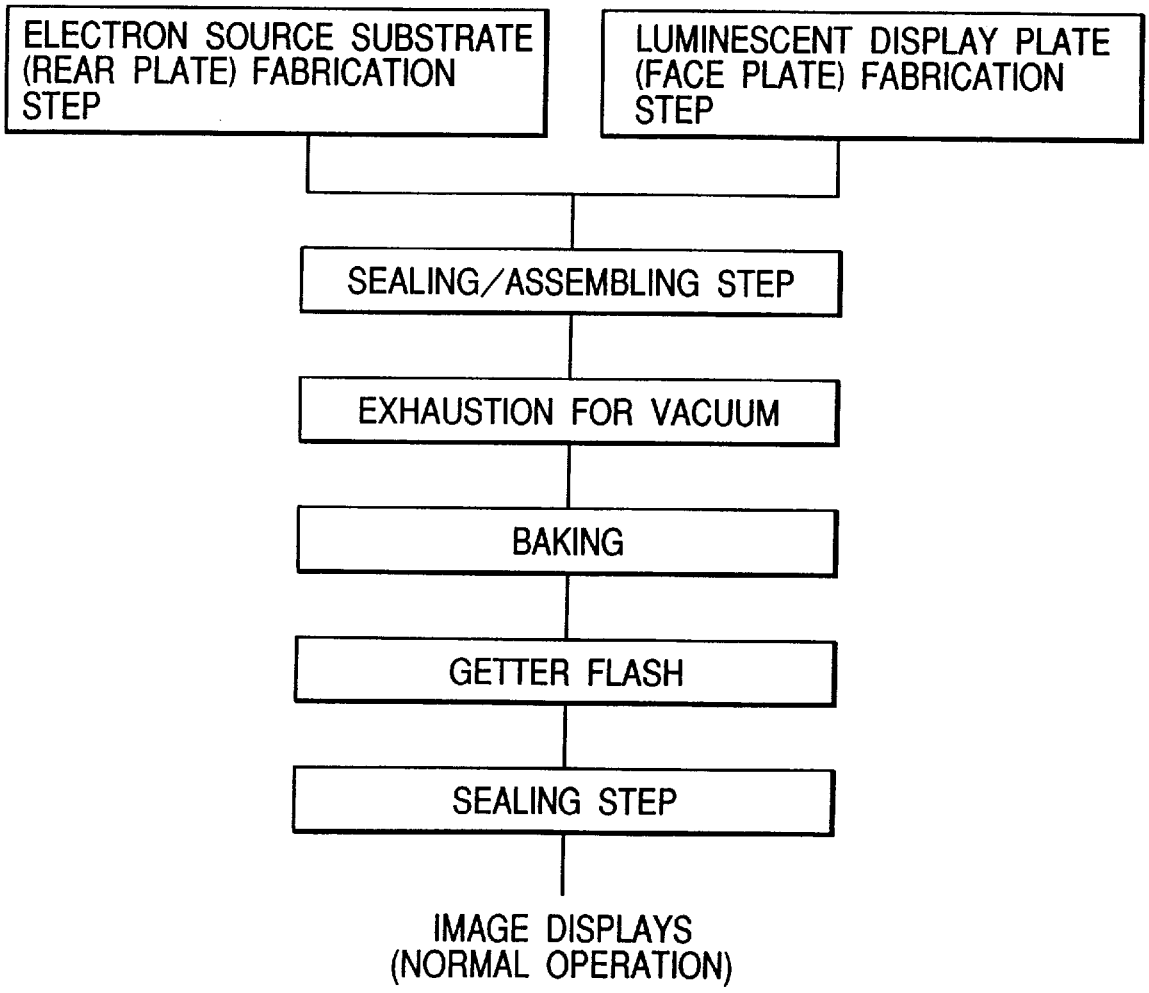
FIG. 28 is a flow chart showing a conventional image forming device fabrication process.
Figure 29A:
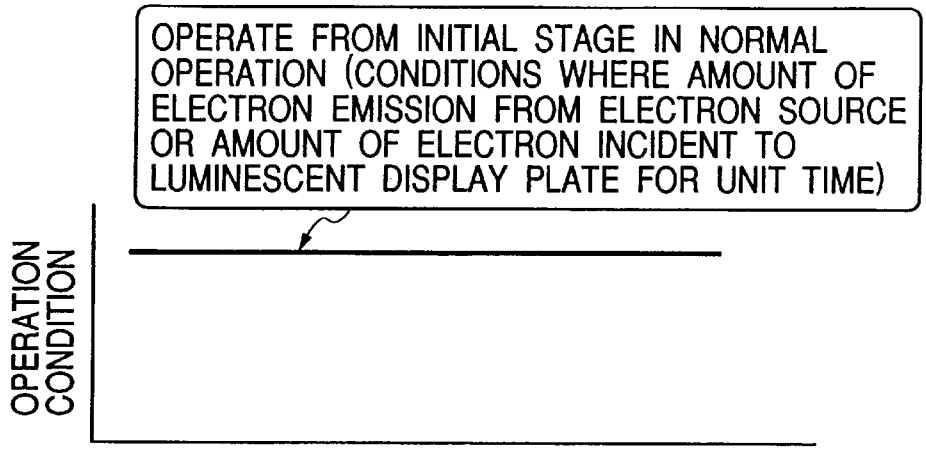
FIGS. 29A, 29B, and 29C are graphs showing vacuum discharge and electron source deterioration generated with a decrease in vacuum degree in the initial operation of the conventional image forming device.
Figure 29B:
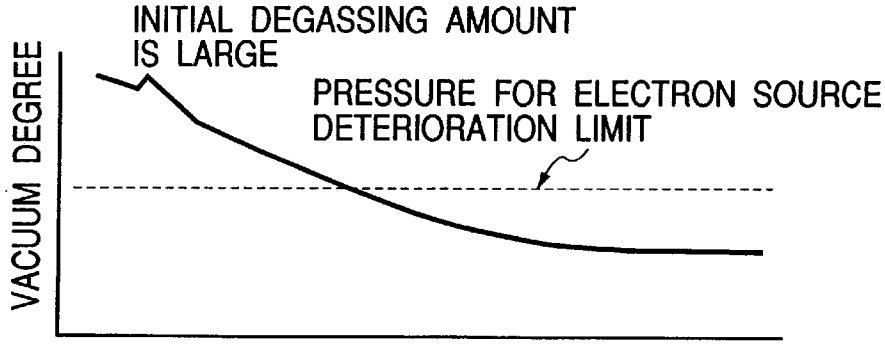
Figure 29C:
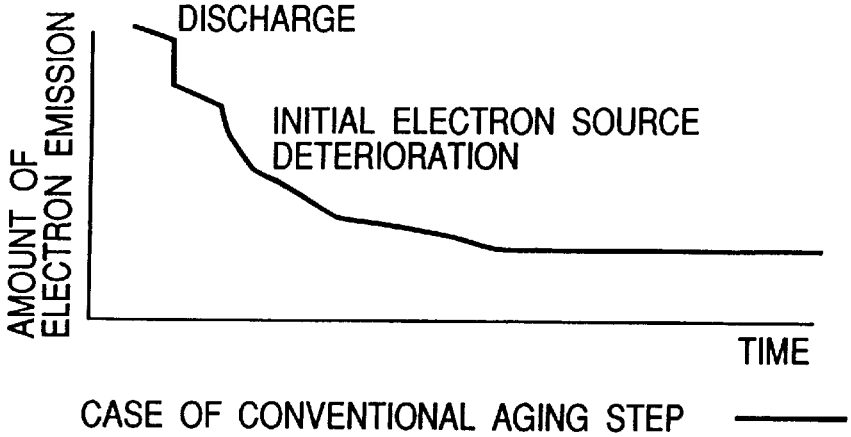

When the partial pressure is used as vacuum information, the partial pressure of a gas which readily influences the electron-emitting element is effective. Especially when a surface-conduction type electron-emitting element is applied as the electron-emitting element, it is effective to measure the partial pressure of $H_2O$ or $O_2$ which readily influences the electron-emitting element. FIGS. 27A and 27B show the relationship between the $H_2O$ and $O_2$ partial pressures and the electron source deterioration rate when a surface-conduction type electron-emitting element is applied. Considering this, operation conditions are desirably controlled using a defined partial pressure as a reference on the basis of the following control logics so as not to exceed this partial pressure.

[Control Logic A-2]

When the $H_2O$ ($O_2$) partial pressure is equal to or lower than the defined $H_2O$ ($O_2$) partial pressure, the drive duty, i.e., at least one of the electron source drive pulse width, drive voltage, drive frequency, and the number of drive elements is increased.

[Control Logic B-2]

When the $H_2O$ ($O_2$) partial pressure is equal to or higher than the defined $H_2O$ ($O_2$) partial pressure, the drive duty, i.e., at least one of the electron source drive pulse width, drive voltage, drive frequency, and the number of drive elements is decreased.

[Control Logic B-2] may be replaced with

[Control Logic B'-2]

When the $H_2O$ ($O_2$) partial pressure is equal to or higher than the defined $H_2O$ ($O_2$) partial pressure, operation conditions are maintained.

The defined $H_2O$ pressure is set to, e.g., $10^{-7}$ Torr or less and desirably to $10^{-11}$ Torr or less, and the defined $O_2$ pressure is set to, e.g., $10^{-7}$ Torr or less and desirably to $10^{-10}$ Torr or less.

Some kinds of fluorescent substances deteriorate in the presence of $O_2$ gas during the use. When such fluorescent substance is employed, the defined partial pressure of $O_2$ gas can be properly set to suppress deterioration of the fluorescent substance. Although the vacuum degree is measured by a vacuum gauge, the characteristics of the electron-emitting element can be used as vacuum information in a broad sense. For example, changes or fluctuations over time in an amount of electron emission and the like can be used.

Detailed Controls of the control logic applied in vacuum monitoring aging will be described.

For example,

The electron source drive pulse width is increased by 1 $\mu$s when the whole pressure is equal to or lower than the defined whole pressure=$10^{-7}$ Torr, and decreased by 1 $\mu$s when the whole pressure is equal to or higher than $10^{-7}$ Torr (Control 1).

The drive frequency is doubled when the whole pressure is equal to or lower than the defined whole pressure=$10^{-7}$ Torr, and maintained when the whole pressure is equal to or higher than 107 Torr (Control 2).

The number of drive elements is doubled when the $H_2O$ partial pressure is equal to or lower than the defined $H_2O$ partial pressure=$10^{-9}$ Torr, and halved when the $H_2O$ partial pressure is equal to or higher than $10^{-9}$ Torr (Control 3).

The element voltage is increased by 0.1 V when the $O_2$ partial pressure is equal to or lower than the defined $O_2$ partial pressure=$10^{-9}$ Torr, and decreased by 0.1 V when the whole pressure is equal to or higher than $10^{-9}$ Torr (Control 4).

The anode voltage is increased by 100 V when the whole pressure is equal to or lower than the defined whole pressure=$10^{-6}$ Torr, and decreased by 100 V when the whole pressure is equal to or higher than $10^{-6}$ Torr (Control 5).

In addition to them, a plurality of operation conditions can be controlled based on a plurality of pieces of vacuum information. For example, The drive pulse width is increased and the drive frequency is doubled when the whole pressure is equal to or lower than the defined whole pressure=$10^{-7}$ Torr, and these conditions are maintained or decreased when the whole pressure is equal to or higher than $10^{-7}$ Torr (Control 6).

Controls 1, 2, and 5 are simultaneously performed. In some cases, it is effective to successively perform different control operations. For example, "Control 2 is performed after Control 1".

The control loop from b) to e) finally ends by g) the stop of aging or f) the end of aging. The criterion of judging whether aging stops includes application (judgement 2) of a great decrease in vacuum degree, e.g., whether the whole pressure exceeds $10^{-5}$ Torr. The criterion of judging whether aging is completed includes operation conditions (judgement 1) for normal operation or operation requiring larger power consumption than normal operation.

The above-mentioned control method is merely an example, and arbitrary control can be adopted without any limitation so long as the control method satisfies the control logics A and B. Control methods can be appropriately selected in accordance with the arrangement and fabrication method of the image forming device.

(Structure of Surface-Conduction Type Electron-Emitting Element)

Figure 1A:
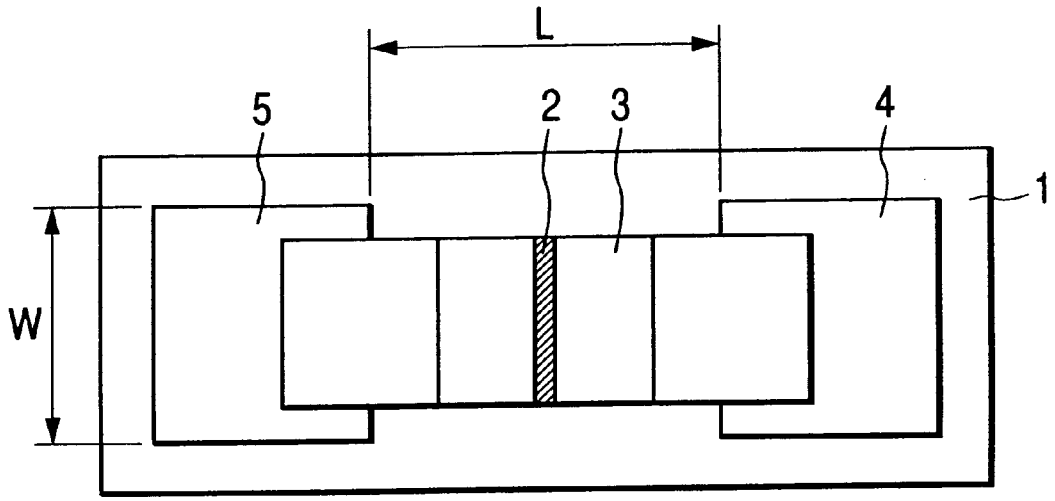
Figure 1B:
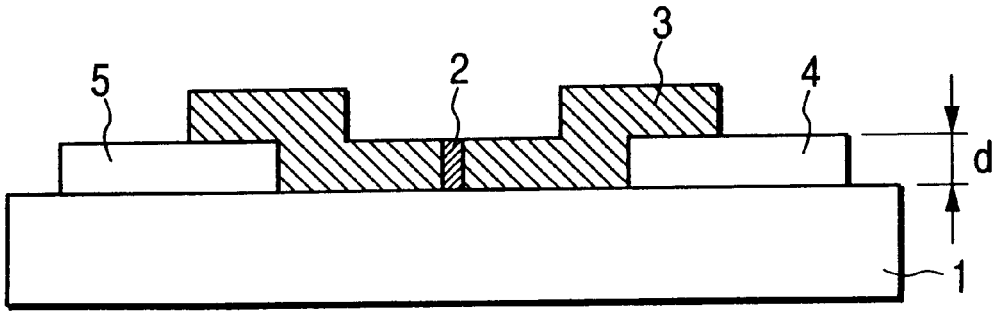

A surface-conduction type electron-emitting element applicable to the image forming device of the present invention will be explained. The basis structures of surface-conduction type electron-emitting elements can be mainly classified into flat and step electron-emitting elements. First, a flat surface-conduction type electron-emitting element will be described. FIG. 1 shows schematic views of a flat surface-conduction type electron-emitting element to which the present invention can be applied. FIG. 1A is a plan view, and FIG. 1B is a sectional view. In FIGS. 1A and 1B, the flat surface-conduction type electron-emitting element comprises a substrate 1, element electrodes 4 and 5, a conductive thin film 3, and an electron-emitting portion 2. Examples of the substrate 1 are a silica glass substrate, a glass substrate having a low impurity content such as an Na substrate, a soda-lime glass, a glass substrate prepared by stacking an $SiO_2$ layer on a soda-lime glass by sputtering or the like, a ceramics substrate such as an alumina substrate, an Si substrate, and the like. An example of a material for the facing element electrodes 4 and 5 is a general conductive material. The general conductive material includes metals such as Ni, Cr, Au, Mo, W, Pt, Ti, Al, Cu, and Pd, or alloys of these metals, metals such as Pd, Ag, Au, $RuO_2$, and Pd-Ag, a printed conductor made of a metal oxide and glass or the like, a transparent conductor such as $In_2O_3$—$SnO_2$, and a semiconductor material such as polysilicon.

An element electrode interval L, an element electrode width W, the shape of the conductive thin film 3, and the like are appropriately designed in accordance with an application purpose or the like. The element electrode interval L can be set within the range from several thousand Å to several hundred $\mu$m, and preferably the range from several $\mu$m to several ten $\mu$m in consideration of a voltage applied between element electrodes and the like. The element electrode width W can be set within the range from several $\mu$m to several hundred $\mu$m in consideration of the resistance value of the electrode and electron-emitting characteristics. A film thickness d of the electrodes 4 and 5 can be set within the range from several hundred Å to several $\mu$m. Note that the surface-conduction type electron-emitting element is not limited to the structure shown in FIG. 1, and can be constituted by sequentially stacking the conductive thin film 3 and the facing element electrodes 4 and 5 on the substrate 1.

The conductive thin film 3 preferably comprises a fine particle film made of fine particles in order to obtain good electron-emitting characteristics. The thickness of the conductive thin film 3 is properly set in consideration of step coverage for the element electrodes 4 and 5, the resistance value between the element electrodes 4 and 5, forming conditions (to be described later), and the like. This thickness is set preferably to the range from several Å to several thousand Å, and more preferably to the range from 10 Å to 500 Å. A resistance value Rs is $10^2$ to $10^7$ Ω/□. Note that Rs appears when a resistance R of a thin film having a thickness t, a width w, and a length l is given by R=Rs(l/w). The present specification will exemplify electrification processing as forming processing, but the forming processing is not limited to this and includes processing of forming a fissure in a film and realizing a high-resistance state.

Examples of a material for the conductive thin film 3 are metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$. $CeB_6$, $YB_4$, and $GdB_4$, carbides such as TiC, ZrC, HfC, TaC, SiC, and WC, nitrides such as TiN, ZrN and HfN, semiconductors such as Si and Ge, and carbons.

The fine particle film is one containing a plurality of fine particles. As the fine structure, individual fine particles may be dispersed, be adjacent to each other, or overlap each other (including that masses of fine particles form an island structure as a whole). One fine particle has a diameter within the range from several Å to several thousand Å, and preferably the range from 10 Å to 200 Å.

Note that the present specification often uses the term "fine particle", and this meaning will be explained. A small particle is called a "fine particle", and a smaller one is called an "ultra fine particle". A particle which is smaller than the "ultra fine particle" and contains atoms about several hundred in number is called a "cluster". However, this classification is not strict and changes depending on a target property. In some cases, both the "fine particle" and "ultra fine particle" are called "fine particles", and the present specification complies with this description. According to "A Lecture on the Experimental Physics 14 Surface•Fine Particle" (K. Kinoshita ed., Kyoritsu Shuppan, Sep. 1, 1986), "In this book, the fine particle means a particle having a diameter from about 2 to 3 μm to about 10 nm. In particular, the ultra fine particle means a particle having a diameter from about 10 nm to about 2 to 3 nm. Both of them may be simply referred to as fine particles, and thus this classification is not strict and is merely a criterion. When the number of atoms forming a particle falls within the range from 2 to about several ten to several hundred, this particle is called a cluster." (lines 22 to 26, p. 195) In addition, according to the "ultra fine particle" by the "Hayashi, Ultra Fine Particle Project" in Research Development Cooperation of Japan, the lower limit of the particle diameter is defined much lower as follows:

> "In the 'Ultra Fine Particle Project' (1981 to 1986) in Exploratory Research for Advanced Technology, a particle having a size (diameter) within the range from 1 to 100 nm is called an "ultra fine particle". That is, one ultra fine particle is a mass of 100 to 108 atoms. Atomically, the ultra fine particle is a large or enormous particle." (S. Hayashi, R. Ueda, A. Tazaki ed., "Ultra Fine Particles—Creative Scientific Technology—", Mita Shuppan, lines 1 to 4, p. 2, 1988) "A particle which is smaller than the ultra fine particle, i.e., is formed from several to several hundred atoms is generally called a cluster." (11. 12–13, p. 2 in the same reference)

Based on these general terms, the "fine particle" in the present specification indicates one which is a mass of many atoms or molecules and is about several Å to 10 Å in lower limit of the diameter and about several μm in upper limit.

The electron-emitting portion 2 has a high-resistance fissure formed at part of the conductive thin film 3. The electron-emitting portion 2 depends on the thickness, quality, and material of the conductive thin film 3, a forming method (to be described later), and the like. The electron-emitting portion 2 may contain conductive fine particles each having a diameter within the several Å to several hundred Å. The conductive fine particles contain some or all of elements of a material forming the conductive thin film 3. Carbon and a carbon compound are contained in and near the electron-emitting portion 2.

Figure 2:
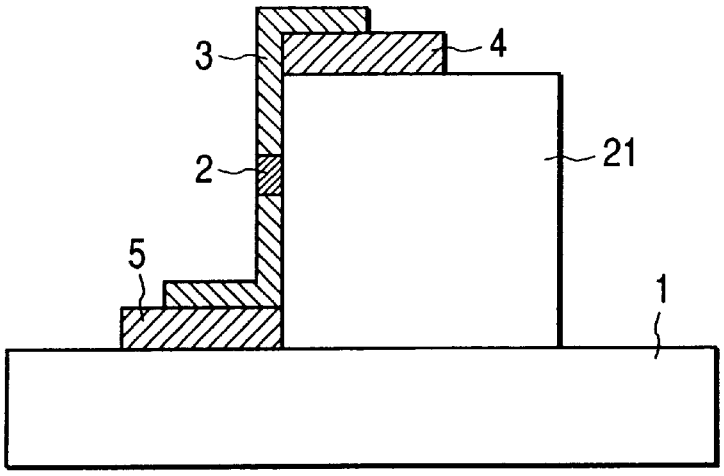
FIG. 2 is a schematic sectional view showing a step surface-conduction type electron-emitting element (surface-conduction type electron-emitting element)

Next, a step surface-conduction type electron-emitting element will be described. FIG. 2 is a schematic view showing an example of a step surface-conduction type electron-emitting element to which the surface-conduction type electron-emitting element of the present invention can be applied. In FIG. 2, the same reference numerals as in FIGS. 1A and 1B denote the same parts. This element comprises a step-forming member 21. A substrate 1, element electrodes 4 and 5, a conductive thin film 3, and an electron-emitting portion 2 can be made of the same materials as in the above-mentioned flat surface-conduction type electron-emitting element. The step-forming member 21 can be made of an insulating material such as $SiO_2$ formed by vacuum evaporation, printing, sputtering, and the like. The thickness of the step-forming member 21 corresponds to the element electrode interval L of the flat surface-conduction type electron-emitting element and can be set within the range from several thousand Å to several ten μm. This thickness is set in consideration of the fabrication method of the step-forming member and a voltage applied between the element electrodes, and preferably set within the range from several hundred Å to several μm.

After the element electrodes 4 and 5 and step-forming member 21 are formed, the conductive thin film 3 is stacked on the element electrodes 4 and 5. In FIG. 2, the electron-emitting portion 2 is formed on the step-forming member 21. The electron-emitting portion 2 depends on fabrication conditions, forming conditions, and the like, and its shape and position are not limited to those in FIG. 2.

Figure 3A:
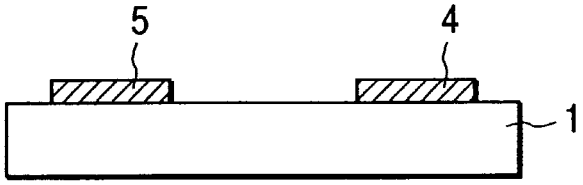
FIGS. 3A, 3B, and 3C are sectional views, respectively, showing steps in fabricating the surface-conduction type electron-emitting element.
Figure 3B:
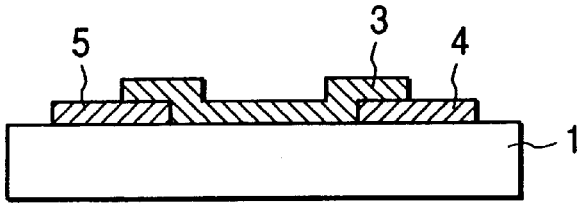
Figure 3C:
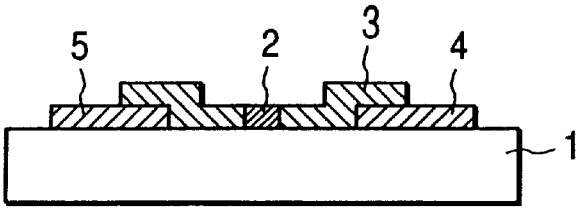

A method of fabricating the surface-conduction type electron-emitting element will be described. The surface-conduction type electron-emitting element can be fabricated by various methods, and an example of the methods is schematically shown in FIGS. 3A to 3C. An example of the fabrication method will be explained with reference to FIGS. 1A, 1B, and 3A to 3C. Also in FIGS. 3A to 3C, the same reference numerals as in FIGS. 1A and 1B denote the same parts.

1) A substrate 1 is satisfactorily cleaned with a detergent, pure water, an organic solvent, or the like, and an element electrode material is deposited by vacuum evaporation, sputtering, or the like to form element electrodes 4 and 5 on the substrate 1 by, e.g., photolithography (FIG. 3A).

2) The substrate 1 having the element electrodes 4 and 5 is coated with an organic metal solvent to form an organic metal thin film. As the organic metal solvent, an organic metal compound solvent containing a metal of a material for the conductive thin film 3 as a main element can be used. The organic metal thin film is heated, sintered, and patterned into a conductive thin film 3 by lift-off, etching, or the like (FIG. 3B). Although the coating method of the organic metal solvent has been exemplified, the formation method of the conductive thin film 3 is not limited to this and can be vacuum evaporation, sputtering, chemical vapor deposition, dispersion coating, dipping, spinner method, or the like.

Figure 4A:
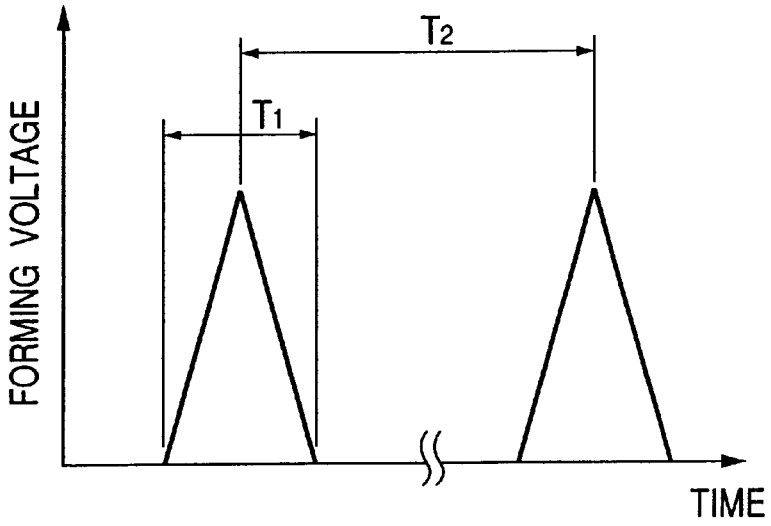
FIGS. 4A and 4B are graphs each showing the voltage waveform of electrification processing used in the forming step.
Figure 4B:
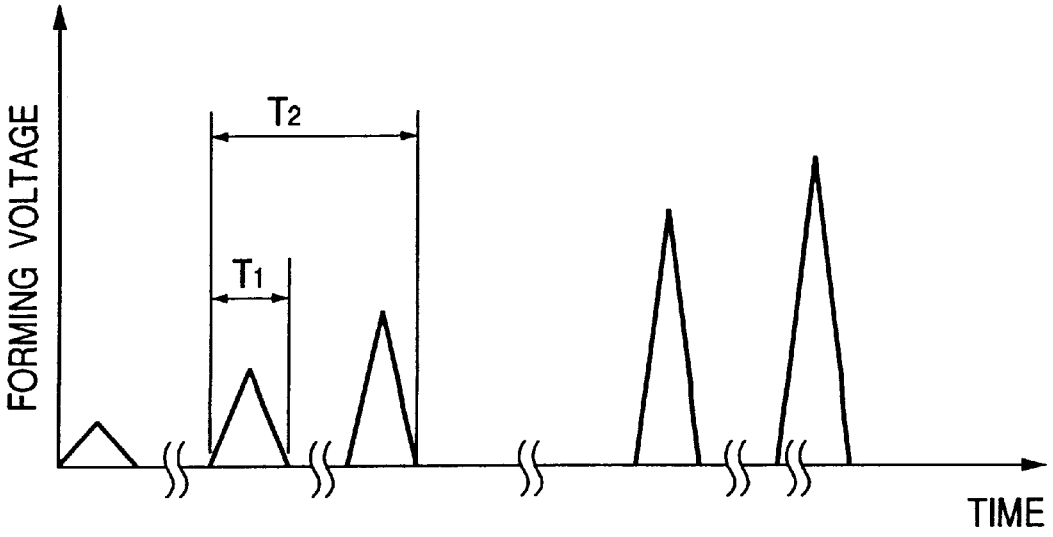

3) The obtained element is subjected to a forming step. As an example of the forming method, an electrification method will be described. When the element electrodes 4 and 5 are electrified by a power supply (not shown), an electron-emitting portion 5 changed in structure is formed at a portion of the conductive thin film 3 (FIG. 3C). According to forming processing, a portion changed in structure such as a portion locally destructed, deformed, or quality-changed is formed in the conductive thin film 3. This portion serves as the electron-emitting portion 5. FIGS. 4A and 4B show examples of a forming voltage waveform. This voltage waveform is preferably a pulse-like waveform. Pulses can be applied by a method, FIG. 4A, of successively applying pulses whose peak value is a constant voltage, or a method, FIG. 4B, of applying voltage pulses while increasing the pulse peak value. $T_1$ and $T_2$ in FIG. 4A represent the pulse width and interval of the voltage waveform, respectively. In general, $T_1$ is set within the range from 1 $\mu$sec to 10 msec, and $T_2$ is set within the range from 10 $\mu$sec to 100 msec. The peak value of a triangular wave (peak voltage in forming processing) is appropriately selected in accordance with the shape of the surface-conduction type electron-emitting element. Under these conditions, the voltage is applied for, e.g., several sec to several ten sec. The pulse waveform is not limited to a triangular waveform and can be a desired waveform such as a rectangular waveform. $T_1$ and $T_2$ in FIG. 4B also represent the pulse width and interval of the voltage waveform, respectively. The peak value of the triangular wave (peak voltage in forming processing) can be increased every step of, e.g., about 0.1 V.

The end of forming processing can be detected by applying such a voltage so as not to locally destruct or deform the conductive thin film 2 during the pulse interval $T_2$ and measuring the current. For example, an element current flowing upon application of a voltage of about 0.1 V is measured to obtain the resistance value, and when the resistance value exhibits 1 MΩ or more, forming processing is completed.

4) The element having undergone forming processing is preferably subjected to processing called an activation step. In the activation step, an element current If and an emission current Ie greatly change. Similar to forming processing, the activation step is executed by repeatedly applying pulses in an atmosphere containing an organic substance gas. This atmosphere can be formed using an organic gas left in an atmosphere when the vacuum vessel is evacuated with an oil diffusion pump, rotary pump, or the like, or using a proper organic substance gas introduced into a vacuum in the vacuum vessel temporarily sufficiently evacuated by an ion pump or the like. The gas pressure of a preferable organic substance changes depending on the application purpose, the shape of the vacuum vessel, the kind of organic substance, and the like, and thus is appropriately set in accordance with them. Examples of the proper organic substance are aliphatic hydrocarbons such as alkane, alkene, alkyne, aromatic hydrocarbons, alcohols, aldehydes, ketones, amines, phenol, and organic acids such as carboxylic acid and sulfonic acid. Detailed examples are saturated hydrocarbons given by $C_nH_{2n+2}$ such as methane, ethane, and propane, unsaturated hydrocarbons given by $C_nH_{2n}$ and the like such as ethylene and propylene, benzene, benzonitrile, trinitrile, toluene, methanol, ethanol, formaldehyde, acetaldehyde, acetone, methyl ethyl ketone, methyl amine, ethyl amine, phenol, formic acid, acetic acid, and propionic acid. By this processing, carbon or a carbon compound is deposited on the element from the organic substance present in the atmosphere to greatly change the element current If and emission current Ie.

The end of the activation step is determined while measuring the element current If and emission current Ie. Note that the pulse width, pulse interval, pulse peak value, and the like are appropriately set.

Carbon and a carbon compound are, e.g., graphite [containing so-called HOPG' or PG (GC); HOPG has an almost perfect graphite crystal structure, PG has a crystal grain size of about 200 Å and a slightly disturbed crystal structure, and GC has a crystal grain size of about 200 Å and a largely disturbed crystal structure.] and amorphous carbon (indicating amorphous carbon and a mixture of amorphous carbon and fine crystals of graphite). The film thickness is set preferably to 500 Å or less, and more preferably to 300 Å or less.

5) The electron-emitting element obtained by these steps is desirably subjected to a stabilization step. In this step, the organic substance in the vacuum vessel is exhausted. The internal pressure of the vacuum vessel is preferably 1 to $3\times10^{-7}$ Torr or less, and more preferably $1\times10^{-8}$ Torr or less. An evacuation device for evacuating the vacuum vessel is preferably one not using any oil so as not to affect element characteristics by oil flowing from the device. More specifically, this evacuation device is a sorption pump, ion pump, or the like. In evacuating the vacuum vessel, the whole vacuum vessel is preferably heated to facilitate exhaustion of organic substance molecules attached to the inner wall of the vacuum vessel and the electron-emitting element. Heating conditions at this time are preferably a temperature of 100 to 300° C. and a time as long as, e.g., 5 hrs or more, but are not particularly limited to them. Heating is performed under conditions properly selected in consideration of various conditions such as the size and shape of the vacuum vessel and the structure of the electron-emitting element. A drive atmosphere after the stabilization step preferably maintains an atmosphere at the end of the stabilization step, but is not limited to this. As far as the organic substance is satisfactorily removed, stable characteristics can be maintained even with a slight decrease in vacuum degree itself. This vacuum atmosphere can be adopted to suppress deposition of new carbon or carbon compound and stabilize the element current If and emission current Ie.

(Characteristics of Surface-Conduction Type Electron-Emitting Element)

Figure 5:
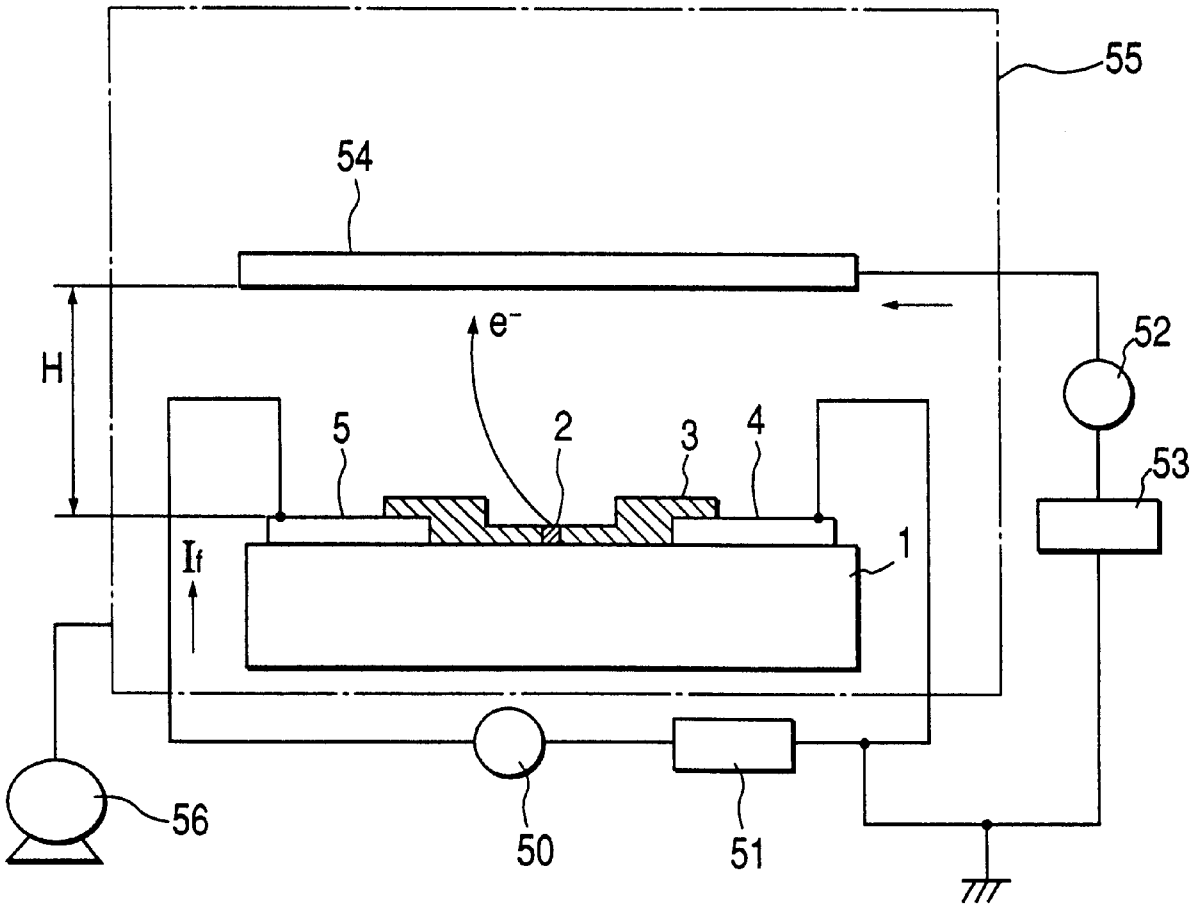
FIG. 5 is a schematic sectional view showing an example of a basic measurement/evaluation system for the surface-conduction type electron-emitting element according to the present invention.

The basic characteristics of the surface-conduction type electron-emitting element will be described with reference to FIGS. 5 and 6. FIG. 5 is a schematic view showing an example of a vacuum processing device. The vacuum processing device also functions as a measurement/evaluation device. Also in FIG. 5, the same reference numerals as in FIGS. 1A and 1B denote the same parts. In FIG. 5, the vacuum processing device comprises a vacuum vessel 55 and an exhaust pump 56. The vacuum vessel 55 incorporates an electron-emitting element. The electron-emitting element is made up of a substrate 1 constituting the electron-emitting element, element electrodes 4 and 5, a conductive thin film 3, and an electron-emitting portion 2. The vacuum processing device further comprises a power supply 51 for applying the element voltage Vf to the electron-emitting element, an ammeter 50 for measuring the element current If flowing through the conductive thin film 3 between the element electrodes 4 and 5, an anode electrode 54 for capturing the emission current Ie from the electron-emitting portion of the element, a high-voltage source 53 for applying the voltage to the anode electrode 54, and an ammeter 52 for measuring the emission current Ie from the electron-emitting portion 5 of the element. For example, the voltage of the anode electrode is set within the range from 1 kV to 10 kV, and a distance H between the anode electrode and electron-emitting element is set within the range from 2 mm to 8 mm. With this setting, the vacuum processing device can perform measurement.

The vacuum vessel 55 incorporates a device (not shown) such as a vacuum gauge necessary for measurement in a vacuum atmosphere to allow measurement and estimation in a desired vacuum atmosphere. The exhaust pump 56 is constituted by a normal high-vacuum device system including turbo and rotary pumps and a ultra-high-vacuum device system including an ion pump and the like. The whole vacuum processing device having the electron source substrate shown in FIG. 5 can be heated up to 200° C. by a heater (not shown). Therefore, steps subsequent to the above-described forming processing can be performed using this vacuum processing device. FIG. 6 is a graph schematically showing the relationship between the emission current Ie, element current If, and element voltage Vf measured using the vacuum processing device shown in FIG. 5. In FIG. 6, since the emission current Ie is much smaller than the element current If, they are given in arbitrary units. Note that both the ordinate and abscissa are based on linear scales.

Figure 6:
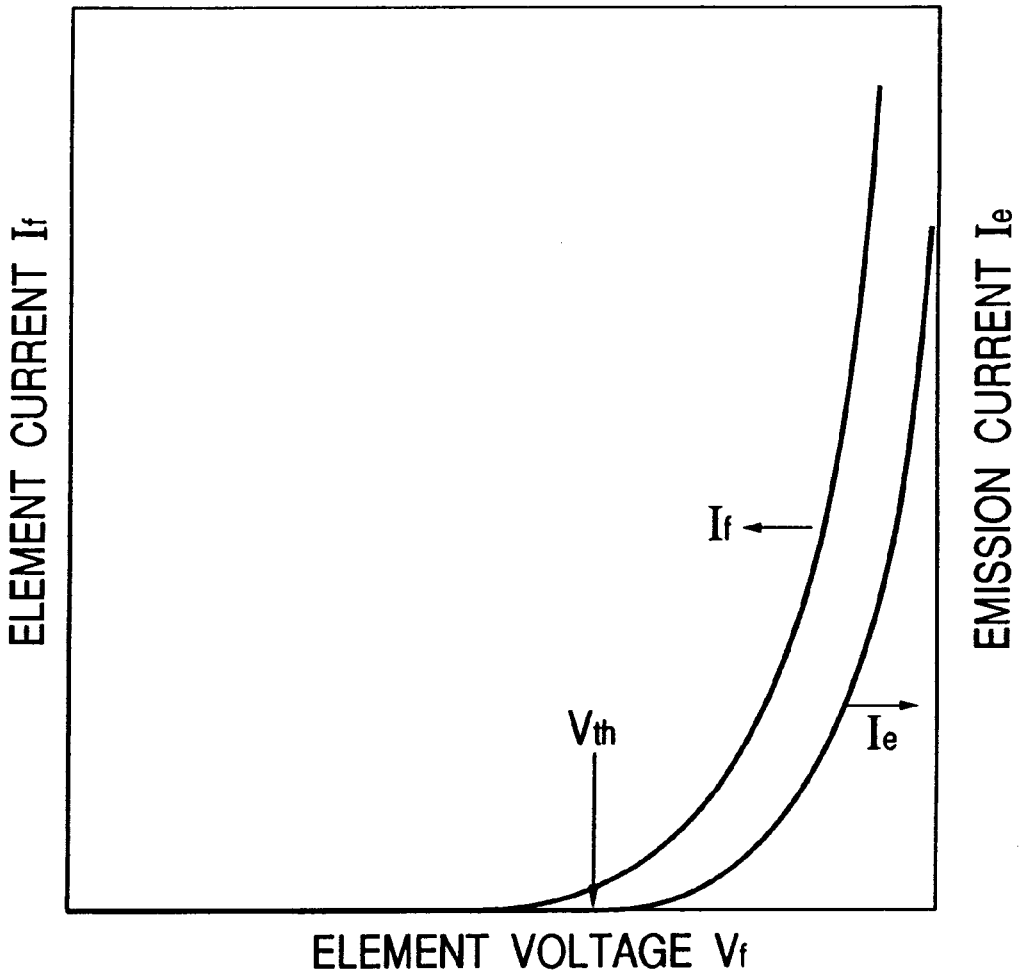
FIG. 6 is a graph showing an example of the emission current vs. element voltage curve (I-V curve) of the surface-conduction type electron-emitting element.

As is apparent from FIG. 6, the surface-conduction type electron-emitting element to which the present invention can be applied has three characteristic features regarding the emission current Ie:

(i) The emission current Ie abruptly increases when an element voltage of a predetermined level (to be referred to as a threshold voltage: Vth in FIG. 6) or higher is applied to the element, but almost no emission current Ie is detected when the voltage is equal to or lower than the threshold voltage Vth. The device is a nonlinear element with a clear threshold voltage Vth with respect to the emission current Ie.

(ii) The emission current Ie can be controlled by the element voltage Vf because the emission current Ie linearly depends on the element voltage Vf.

(iii) Emission charges captured by the anode electrode 54 depend on the application time of the element voltage Vf. In other words, a charge amount captured by the anode electrode 54 can be controlled by the application time of the element voltage Vf.

As is apparent from the above description, the electron-emitting characteristics of the surface-conduction type electron-emitting element can be easily controlled in accordance with an input signal. By using this property, the surface-conduction type electron-emitting element can be applied to various devices such as an electron source constituted by arranging a plurality of electron-emitting elements, and an image forming device.

(Arrangement of Image Forming Device)

Figure 8:
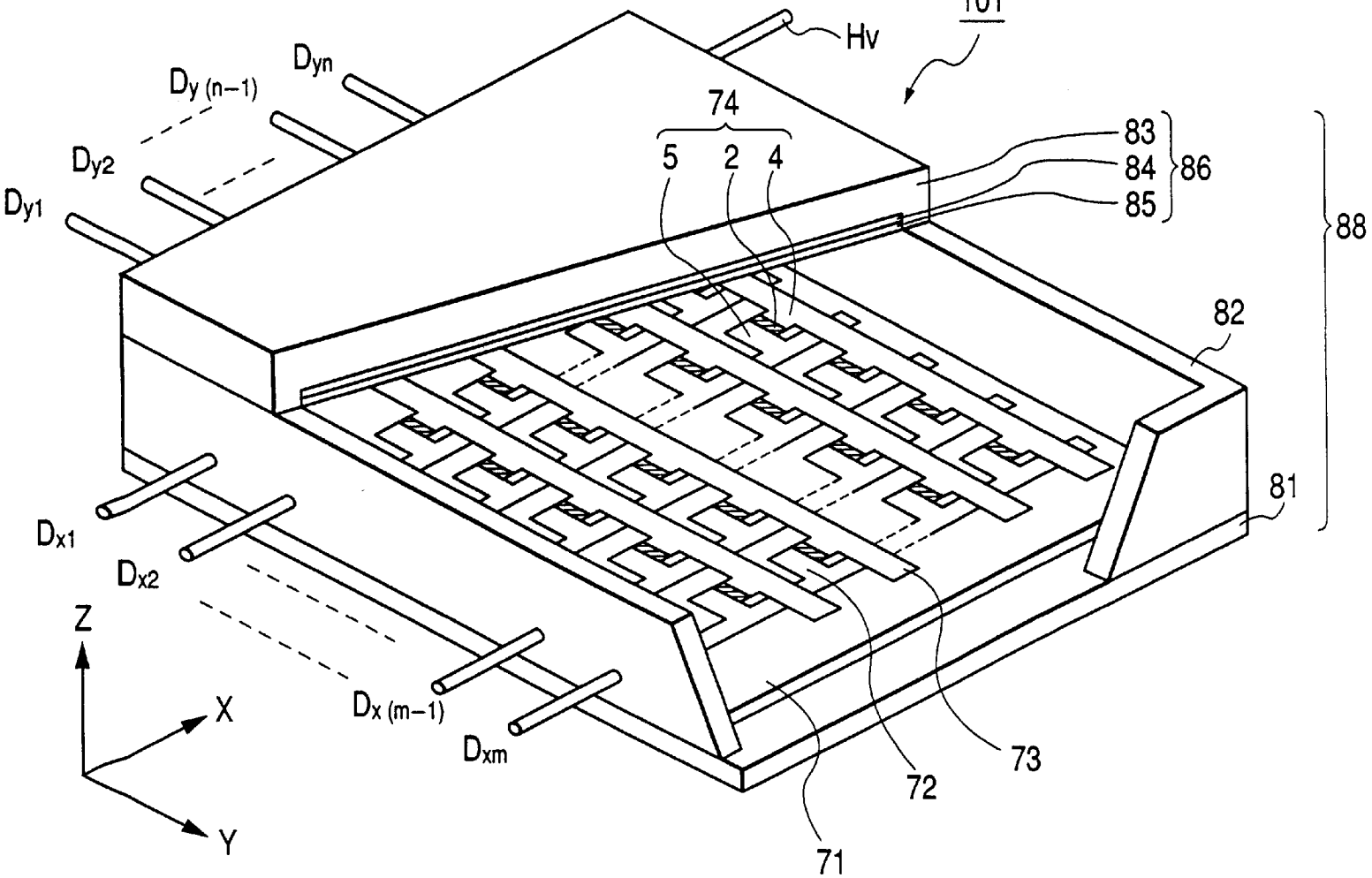
FIG. 8 is a schematic perspective view showing part of a display panel used in an image forming device using the electron source substrate with a simple matrix layout.
Figure 9A:
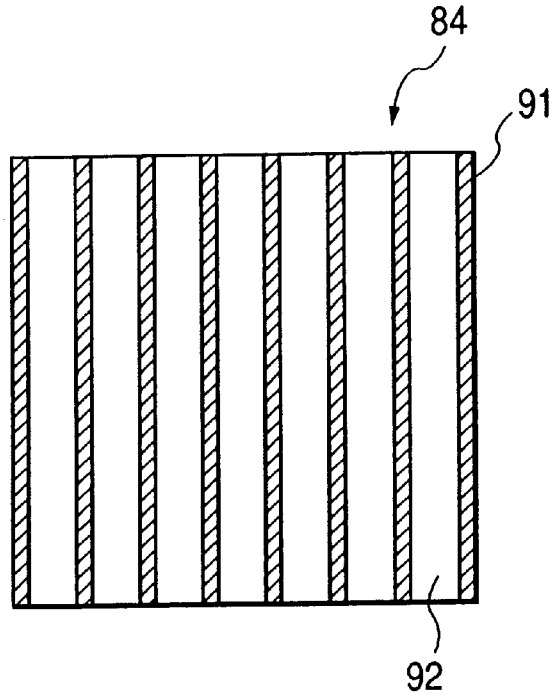
FIGS. 9A and 9B are views each showing a fluorescent film on the display panel in FIG. 8.
Figure 9B:
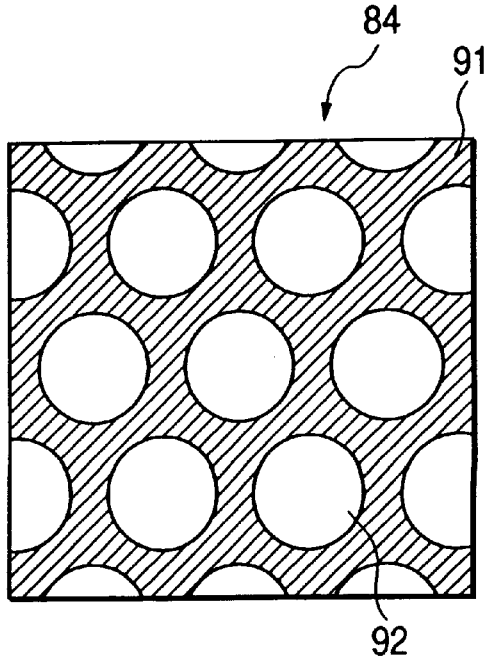
Figure 10:
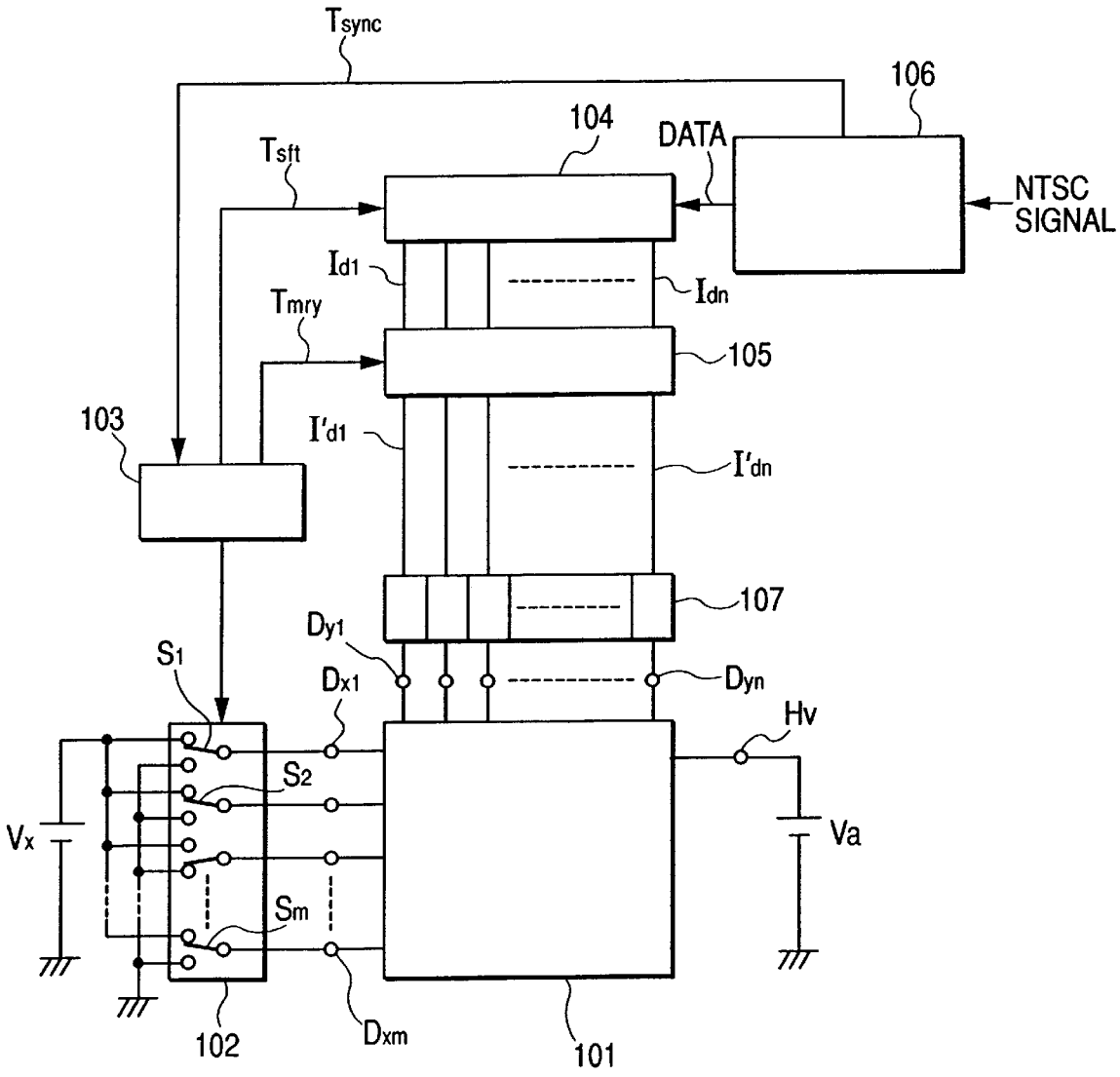
FIG. 10 is a block diagram showing an example of a drive circuit for driving the display panel in FIG. 8.

The arrangement of an image forming device in which a plurality of surface-conduction type electron-emitting elements according to the present invention are arranged on a substrate will be described with reference to FIGS. 8, 9A, 9B, and 10. FIG. 8 is a schematic view showing an example of the display panel of the image forming device. FIGS. 9A and 9B are schematic views each showing a fluorescent film used in the image forming device in FIG. 8. FIG. 10 is a block diagram showing an example of a drive circuit for performing display in accordance with a TV signal of the NTSC scheme.

In FIG. 8, the image forming device is constituted by an electron source substrate 71 on which a plurality of electron-emitting elements are arranged, a luminescent display plate (face plate) 86 facing the electron source substrate via a vacuum portion, a rear plate 81 fixing the electron source substrate 71, a support frame 82 connected to the rear and face plates 81 and 86 with a frit glass or the like, and an envelope 88 which is sealed by sintering in a nitrogen atmosphere at a temperature of 400 to 500° C. for 10 min or more. The interval between the electron source substrate and luminescent display plate is about several mm to several ten mm.

An electron-emitting portion 2 corresponds to that in FIGS. 1A and 1B. Element electrodes 4 and 5 of the surface-conduction type electron-emitting element are respectively connected to x- and y-direction wiring lines 72 and 73.

As described above, the envelope 88 is made up of the face plate 86, support frame 82, and rear plate 81. When the substrate 71 itself has a satisfactory strength, the rear plate 81 can be eliminated because the rear plate 81 is employed to reinforce mainly the strength of the substrate 71. That is, the support frame 82 may be directly connected to the substrate 71 to constitute the envelope 88 by the face plate 86, support frame 82, and substrate 71. Further, a support (not shown) called a spacer may be disposed between the face and rear plates 86 and 81 to constitute an envelope 88 having a strength enough to stand the atmospheric pressure.

The image forming device of the present invention displays an image by respectively applying scan and modulation signals from a signal generation means to the electron source substrate to emit electrons, applying the anode voltage Va of several kV or more to the luminescent display plate via a high-voltage terminal HV to accelerate the electron beam and collide it against the fluorescent film, and exciting the fluorescent film to emit light.

The respective constituents will be explained.

(Luminescent Display Plate)

The luminescent display plate 83, i.e., face plate will be first described. The luminescent display plate is constituted by forming a fluorescent film 84, a metal back 85, and the like on a glass substrate 83. FIGS. 9A and 9B are schematic views each showing the fluorescent film. For monochrome display, the fluorescent film 84 can be formed from only fluorescent substance. A color fluorescent film can be formed from a black conductive material 91 called a black stripe or matrix, and a fluorescent substance 92 in accordance with the layout of the fluorescent substance. The black stripe or matrix is provided to suppress color mixing or the like by coloring in black the boundaries between respective fluorescent substances 92 of three primary colors necessary for color display, and to suppress a decrease in contrast by shutting off reflection of external light by the fluorescent film 84. Examples of a material for the black stripe are a material containing normally used graphite as a main component, and a conductive material which hardly transmits and reflects light.

As a method of coating the glass substrate 83 with a fluorescent substance, precipitation, printing, or the like can be adopted regardless of the monochrome or color display. The metal back 85 is generally formed on the inner surface of the fluorescent film 84. The metal back is provided to increase the luminance by mirror-reflecting to the face plate 86 part of light emitted from the fluorescent substance toward the inner surface, to operate the metal back 85 as an electrode for applying an electron beam acceleration voltage, and to protect the fluorescent substance from damage by collision of anions generated in the envelope. The metal back is formed by performing smoothing processing (generally called "filming") for the inner surface of the fluorescent film after formation of the fluorescent film, and depositing Al by vacuum evaporation or the like.

To improve the conductivity of the fluorescent film 84, the face plate 86 may comprise a transparent electrode (not shown) on the outer surface of the fluorescent film 84. In sealing, fluorescent substances of respective colors and electron-emitting elements must correspond to each other and must be aligned with high precision.

(Electron Source Substrate)

The electron source substrate will be described. Electron-emitting elements on the electron source substrate can take various layouts. An example of the layout is a ladder-like layout in which a plurality of rows (to be referred to as a row direction hereinafter) of a plurality of electron-emitting elements arranged parallel and connected at the two terminals of each device are arranged, and electrons emitted from the electron-emitting elements are controlled by a control electrode (to be referred to as a grid hereinafter) arranged above the electron-emitting elements in a direction (to be referred to as a column direction hereinafter) perpendicular to this wiring. Another example is a layout in which a plurality of electron-emitting elements are arranged in a matrix in the x and y directions, one electrode of each of a plurality of electron-emitting elements arranged on the same row is commonly connected to an x-direction wiring line, and the other electrode of each of a plurality of electron-emitting elements arranged on the same column is commonly connected to a y-direction wiring line. This layout is called a so-called simple matrix layout. The simple matrix layout will be described in detail.

Figure 7:
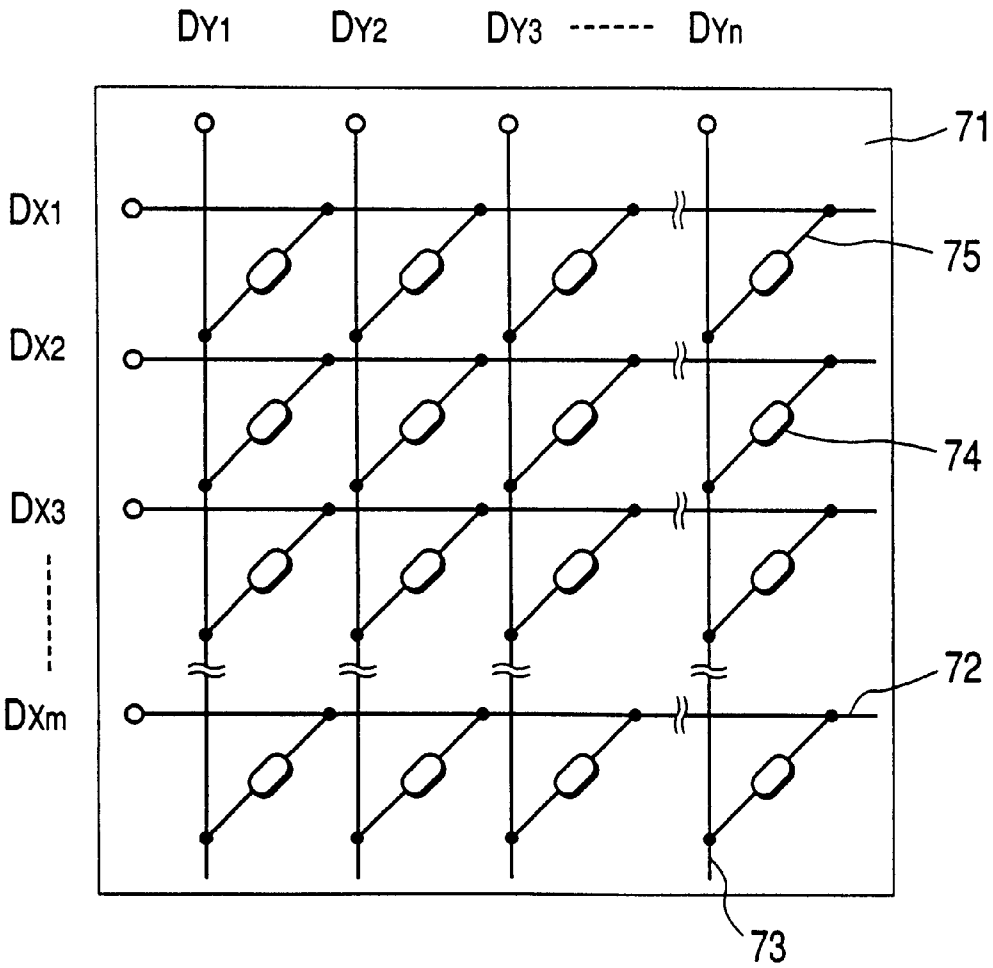
FIG. 7 is a schematic plan view showing an electron source substrate with a simple matrix layout.

The surface-conduction type electron-emitting element to which the present invention can be applied has the above-mentioned features (i) to (iii). That is, when the voltage is equal to or higher than the threshold voltage, electrons emitted from the surface-conduction type electron-emitting element can be controlled by the peak value and width of a pulse-like voltage applied between facing element electrodes. When the voltage is equal to or lower than the threshold voltage, almost no electrons are emitted. According to this feature, even if many electron-emitting elements are arranged, a pulse-like voltage can be appropriately applied to each element to select a given surface-conduction type electron-emitting element and control the electron emission amount in accordance with an input signal. On the basis of this principle, an electron source substrate obtained by arranging a plurality of electron-emitting elements will be explained with reference to FIG. 7. In FIG. 7, x- and y-direction wiring lines 72 and 73, surface-conduction type electron-emitting elements 74, and connections 75 are formed on an electron source substrate 71. Note that the surface-conduction type electron-emitting element 74 may be of a flat or step type.

M x-direction wiring lines 72, which are represented by DX1, DX2, . . . , DXm, can be made of, e.g., a conductive metal formed by vacuum evaporation, printing, sputtering, or the like. The material, thickness, and width of the wiring line are properly designed. N Y-direction wiring lines 73, which are represented by DY1, DY2, . . . , DYn, are formed similarly to the x-direction wiring lines 72. An interlevel insulating layer (not shown) is formed between the m x-direction wiring lines 72 and n y-direction wiring lines 73 to electrically isolate them (m, n are positive integers).

The interlevel insulating layer (not shown) is made of, e.g., $Si_2$ formed by vacuum evaporation, printing, sputtering, or the like. For example, the interlevel insulating layer is formed into a desired shape on the entire surface or part of the substrate 71 having the x-direction wiring lines 72. The thickness, material, and fabrication method are appropriately set to stand particularly a potential difference at the intersection of the x- and y-direction wiring lines 72 and 73. The x- and y-direction wiring lines 72 and 73 are extracted as external terminals.

A pair of electrodes (not shown) constituting the surface-conduction type electron-emitting element 74 are electrically connected by the m x-direction wiring lines 72, n y-direction wiring lines 73, and connection 75 made of, e.g., a conductive metal.

A material for forming the wiring lines 72 and 73, a material for forming the connection 75, and a material for forming the pair of element electrodes may contain some or all of the constituents which are the same, or may contain different constituents. These materials are appropriately selected from the above-described materials for the element electrodes. When a material for forming the element electrodes is the same as a material for forming the wiring lines, a wiring line connected to the element electrode may serve as an element electrode.

The x-direction wiring lines 72 are connected to a scan signal application means (not shown) for applying a scan signal for selecting a row of surface-conduction type electron-emitting elements 74 arranged in the x direction. The y-direction wiring lines 73 are connected to a modulation signal generation means (not shown) for modulating each column of surface-conduction type electron-emitting elements 74 arranged in the y direction in accordance with an input signal. A drive voltage applied to each electron-emitting element is applied as a difference voltage between scan and modulation signals applied to this element.

In this arrangement, individual elements can be selected and independently driven using simple matrix wiring.

An example of the arrangement of a drive circuit for performing television display based on a television signal of the NTSC scheme on a display panel constituted using an electron source with a simple matrix layout will be explained with reference to FIG. 10. In FIG. 10, the drive current comprises an image display panel 101, a scan circuit 102, a control circuit 103, a shift register 104, a line memory 105, a sync signal separation circuit 106, a modulation signal generator 107, and DC voltage sources Vx and Va.

The display panel 101 is connected to an external electric circuit via terminals Dox1 to Doxm and Doy1 to Doyn and a high-voltage terminal Hv. The terminals Dox1 to Doxm receive scan signals for sequentially driving the electron source on the display panel, i.e., a group of surface-conduction type electron-emitting elements arranged in an M×N matrix in units of lines (in units of N elements). The terminals Dy1 to Dyn receive modulation signals for controlling the electron beams output from the surface-conduction type electron-emitting elements corresponding to one line selected by the scan signals. The high-voltage terminal Hv receives a DC voltage of, e.g., 10 k [V] from the DC voltage source Va. This voltage is an acceleration voltage for giving energy enough to excite the fluorescent substance to the electron beam emitted from the surface-conduction type electron-emitting element.

The scan circuit 102 will be described next. This circuit incorporates M switching elements (denoted by reference symbols Si to Sm in FIG. 10). Each switching element selects either an output voltage from the DC voltage source Vx or 0 [V] (ground level) and is electrically connected to a corresponding one of the terminals Dx1 to Dxm of the display panel 101. The switching elements Si to Sm operate on the basis of a control signal Tscan output from the control circuit 103. The scan circuit 102 can be easily formed in combination with switching elements such as FETs.

The DC voltage source Vx is set on the basis of the characteristics (electron-emitting threshold voltage) of the surface-conduction type electron-emitting element to output a constant voltage such that the drive voltage to be applied to an element not scanned is set to the electron-emitting threshold voltage or less.

The control circuit 103 functions to match the operations of respective components with each other so as to perform proper display on the basis of an externally input image signal. The control circuit 103 generates control signals Tscan, Tsft, and Tmry for respective components on the basis of a sync signal Tsync sent from the sync signal separation circuit 106.

The sync signal separation circuit 106 separates sync signal and luminance signal components from an externally input NTSC television signal. This circuit can be easily formed by using a general frequency separation (filter) circuit or the like. The sync signal separated by the sync signal separation circuit 106 is made up of vertical and horizontal sync signals. For the sake of descriptive convenience, the sync signal is shown as the signal Tsync. The luminance signal component of an image, which is separated from the television signal, is expressed as a signal DATA for the sake of convenience. The signal DATA is input to the shift register 104. The shift register 104 serial/parallel-converts the signal DATA, which is serially input in a time-series manner, in units of lines of an image. The shift register 104 operates based on the control signal Tsft sent from the control circuit 103. (In other words, the control signal Tsft is a shift clock for the shift register 104.) Serial/parallel-converted 1-line data (corresponding to drive data for N electron-emitting elements) is output as N signals Id1 to Idn from the shift register 104.

The line memory 105 is a memory for storing 1-line data for a required period of time. The line memory 105 properly stores the contents of the signals Id1 to Idn in accordance with the control signal Tmry sent from the control circuit 103. The stored contents are output as data I'd1 to I'dn to the modulation signal generator 107. The modulation signal generator 107 is a signal source for properly driving and modulating each surface-conduction type electron-emitting element in accordance with each of the image data I'd1 to I'dn. Output signals from the modulation signal generator 107 are applied to the surface-conduction type electron-emitting elements in the display panel 101 through the terminals Doy1 to Doyn.

As described above, the electron-emitting element to which the present invention can be applied has the following basic characteristics with respect to the emission current Ie. A clear threshold voltage Vth is set for electron emission, and each element emits electrons only when a voltage equal to or higher than Vth is applied. For a voltage equal to or higher than the electron-emitting threshold, the emission current changes with a change in voltage applied to the element. When a pulse-like voltage is applied to the element, no electrons are emitted if the voltage is lower than the electron-emitting threshold. If, however, the voltage is equal to or higher than the electron-emitting threshold, the element emits an electron beam. In this case, the intensity of the output electron beam can be controlled by changing a peak value Vm of the pulse. In addition, the total amount of output electron beam charges can be controlled by changing a width Pw of the pulse.

Hence, as a scheme of modulating an output from the electron-emitting element in accordance with an input signal, a voltage modulation scheme, a pulse width modulation scheme, or the like can be used. In executing the voltage modulation scheme, a voltage modulation circuit for generating a voltage pulse with a constant length and modulating the peak value of the pulse in accordance with input data can be used as the modulation signal generator 107. In executing the pulse width modulation scheme, a pulse width modulation circuit for generating a voltage pulse with a constant peak value and modulating the width of the voltage pulse in accordance with input data can be used as the modulation signal generator 107.

As the shift register 104 and line memory 105 may be of a digital or analog signal type because they can only serial/parallel-convert and store an image signal at predetermined speeds.

When these components are of the digital signal type, the output signal DATA from the sync signal separation circuit 106 must be converted into a digital signal. For this purpose, an A/D converter may be connected to the output terminal of the sync signal separation circuit 106. The circuit used for the modulation signal generator 107 changes depending on whether the line memory 105 outputs a digital or analog signal. More specifically, in the voltage modulation scheme using a digital signal, for example, the modulation signal generator 107 employs a D/A conversion circuit, and an amplification circuit or the like is added thereto, as needed. In the pulse width modulation scheme, for example, the modulation signal generator 107 employs a circuit as a combination of a high-speed oscillator, a counter for counting the wave number of the signal output from the oscillator, and a comparator for comparing the output value from the counter with the output value from the memory. If necessary, this circuit can include an amplifier for amplifying the voltage of the pulse-width-modulated signal output from the comparator to the drive voltage for the surface-conduction type electron-emitting element.

In the voltage modulation scheme using an analog signal, for example, the modulation signal generator 107 can adopt an amplification circuit using an operational amplifier and the like, and a shift level circuit or the like can be added thereto, as needed. In the pulse width modulation scheme, for example, the modulation signal generator 107 can adopt a voltage-controlled oscillator (VCO), and an amplifier for amplifying an output from the oscillator to the drive voltage for the surface-conduction type electron-emitting element can be added thereto, as needed.

In the image display device having this arrangement to which the present invention can be applied, a voltage is applied to surface-conduction type electron-emitting elements via the outer terminals Dox1 to Doxm and Doy1 to Doyn to emit electrons. A high voltage is applied to the metal back 85 or transparent electrode (not shown) via the high-voltage terminal Hv to accelerate the electron beams. The accelerated elections collide with the fluorescent film 84 to cause it to emit light, thereby forming an image.

The above arrangement of the image forming device is merely an example of the image forming device to which the present invention can be applied. Various changes and modifications of the arrangement can be made within the spirit and scope of the present invention. Although the arrangement uses an input signal of the NTSC scheme, the input signal is not limited to this. For example, the input signal may be of the PAL or SECAM scheme or a TV signal (high-definition TV such as MUSE) scheme using a larger number of scan lines.

Figure 11:
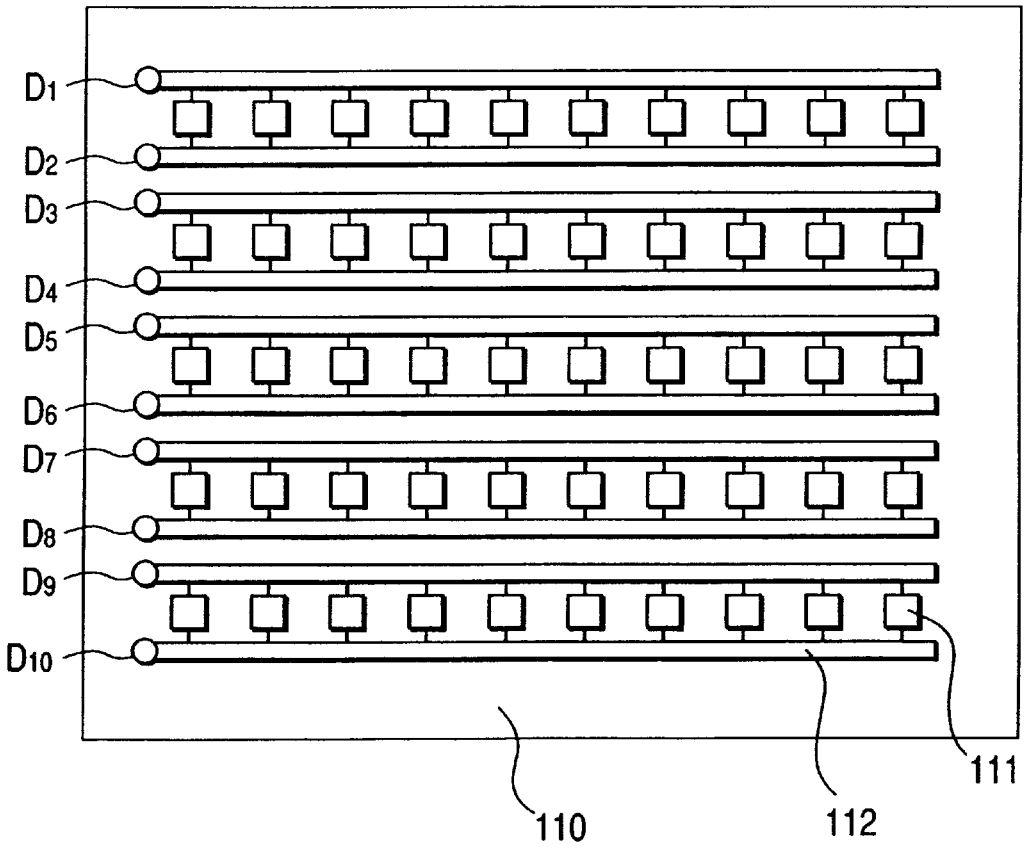
FIG. 11 is a schematic plan view showing an electron source substrate with a ladder-like layout.

Next, an image forming device constituted by an electron source substrate with a ladder-like layout will be described with reference to FIGS. 11 and 12. FIG. 11 is a schematic view showing an example of an electron source with a ladder-like layout. In FIG. 11, the electron source is constituted by an electron source substrate 110, electron-emitting elements 111, and common wiring lines 112 (Dx1 to Dx10) for connecting the electron-emitting elements 111. A plurality of electron-emitting elements 111 are arranged parallel in the x direction on the substrate 110 (to be referred to as an element row). A plurality of element rows are laid out to constitute the electron source. Respective element rows can be independently driven by applying a drive voltage between the common wiring lines of the element rows. That is, a voltage equal to or higher than the electron-emitting threshold is applied to an element row required to emit an electron beam, whereas a voltage equal to or lower than the electron-emitting threshold is applied to an element row not to emit any electron beam. The common wiring lines Dx2 to Dx9 between element rows can be changed such that Dx2 and Dx3 share the same wiring line.

Figure 12:
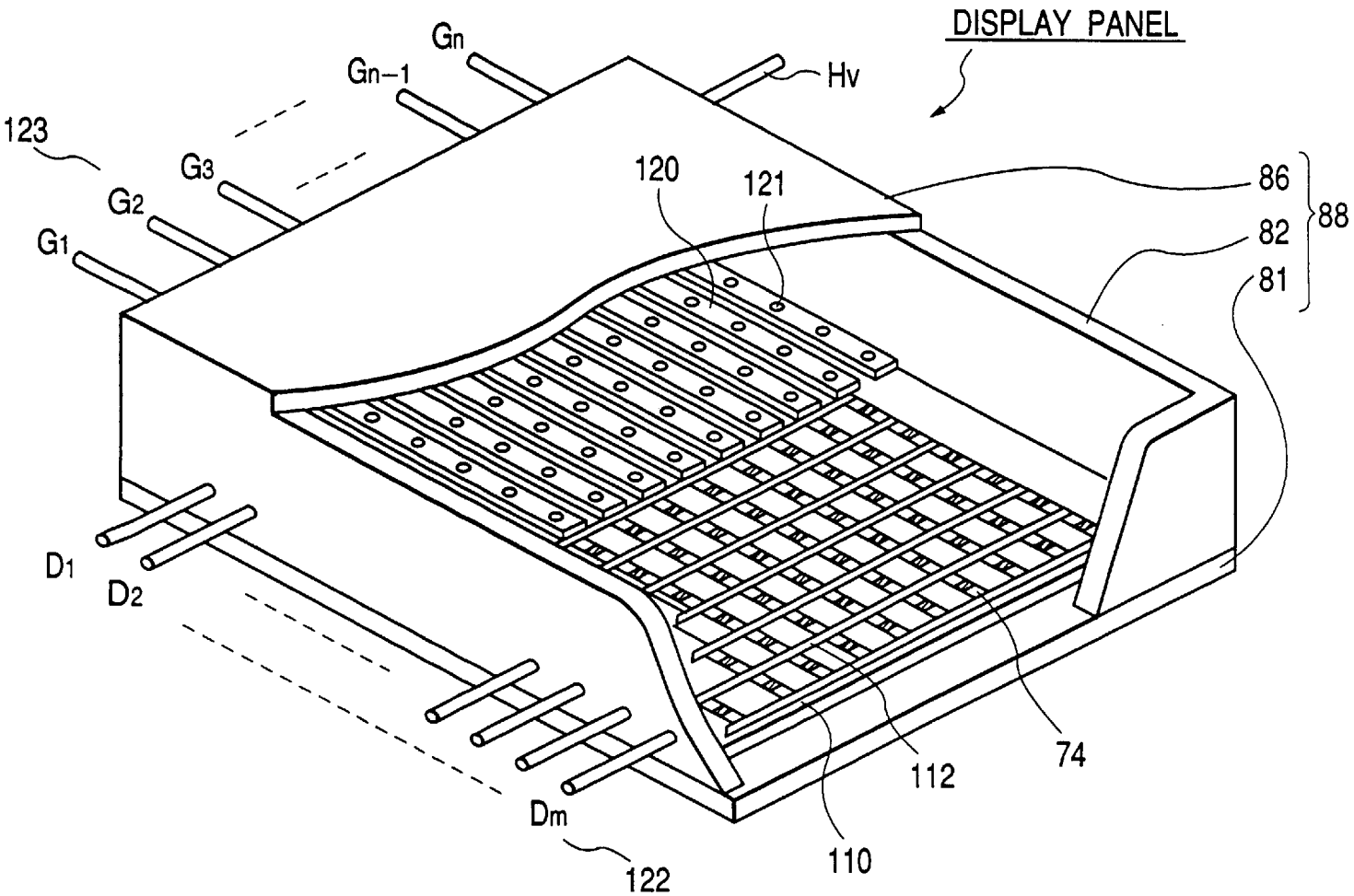
FIG. 12 is a schematic perspective view showing part of a display panel used in an image forming device using the electron source substrate with a ladder-like layout.

FIG. 12 is a schematic view showing an example of the panel structure in the image forming device having the electron source with a ladder-like layout. This panel comprises grid electrodes 120, openings 121 for passing through electrons, outer terminals 122 (Dox1, Dox2, . . . , Doxm), outer terminals 123 (G1, G2, . . . , Gn) connected to the grid electrodes 120, and an electron source substrate 124 on which common wiring lines are shared between element rows. In FIG. 12, the same reference numerals as in FIGS. 8 and 11 denote the same parts. The image forming device shown in FIG. 12 is greatly different from the image forming device with a simple matrix layout shown in FIG. 8 in the presence of the grid electrode 120 between the electron source substrate 110 and a face plate 86.

In FIG. 12, the grid electrode 120 is interposed between the substrate 110 and face plate 86. The grid electrode 120 modulates an electron beam emitted by the surface-conduction type electron-emitting element. The grid electrode 120 has the circular opening 121 in correspondence with each element in order to pass an electron beam through the stripe electrode perpendicular to each element row of the ladder-like layout. The shape and position of the grid are not limited to those shown in FIG. 12. For example, many aperture holes can be formed as openings in a mesh manner, and the grids can be formed around or near the surface-conduction type electron-emitting element.

The outer terminals 122 and grid outer terminals 123 are electrically connected to a control circuit (not shown).

In the image forming device of this example, 1-line modulation signals are simultaneously applied to grid electrode columns while sequentially driving (scanning) element rows in units of lines. With this operation, irradiation of each electron beam on the fluorescent substance can be controlled to display an image in units of lines. The image forming device of the present invention can be used as a display device for television broadcasting, a display device for a video conference system, computer, and the like, and an image forming device serving as an optical printer constituted by a photosensitive drum and the like.

(Image Forming Device Fabrication Method)

The above-described image forming device can be fabricated by various methods. An example of the fabrication methods will be described below.

1) Formation of Electron Source Substrate

Figure 13:
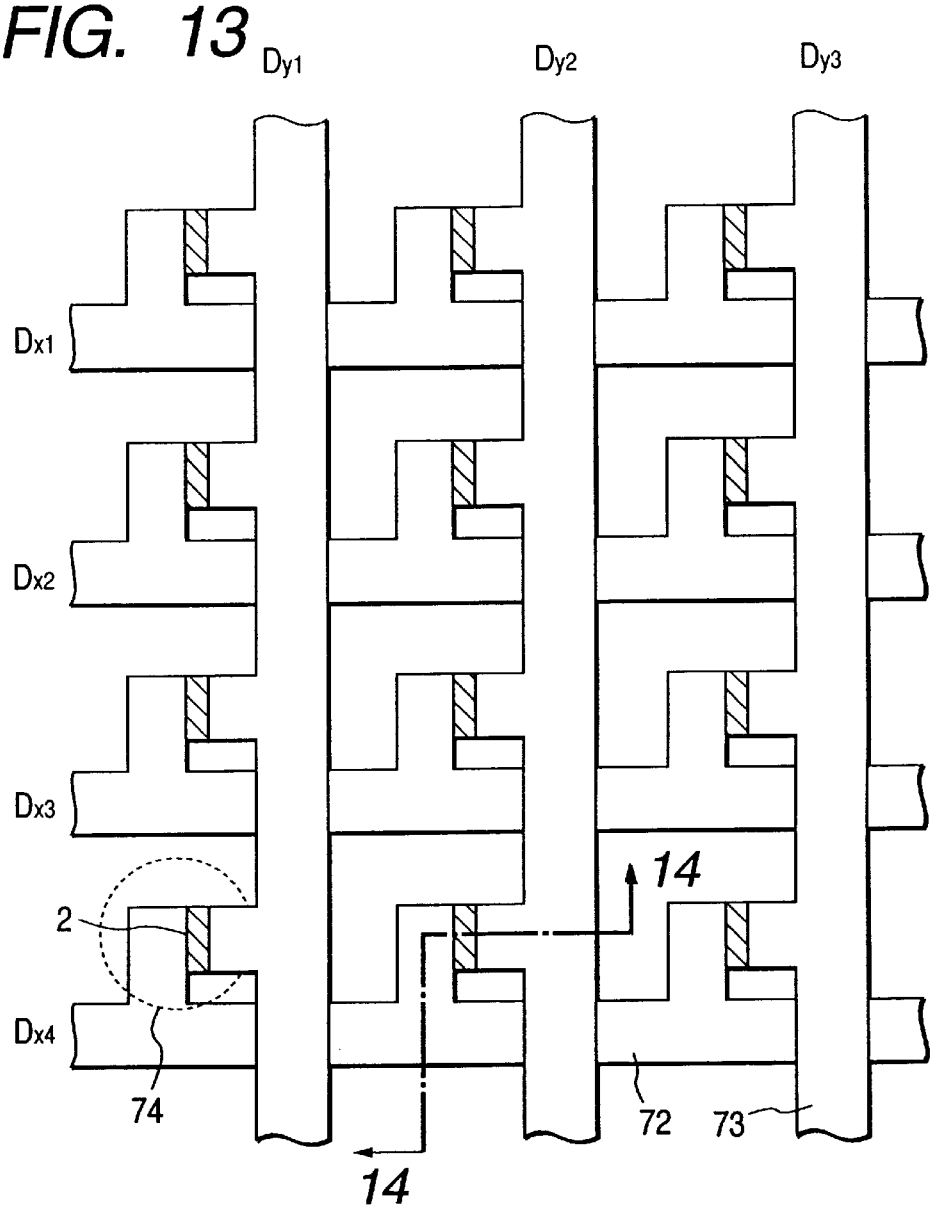
FIG. 13 is a plan view showing part of the electron source substrate.
Figure 14:
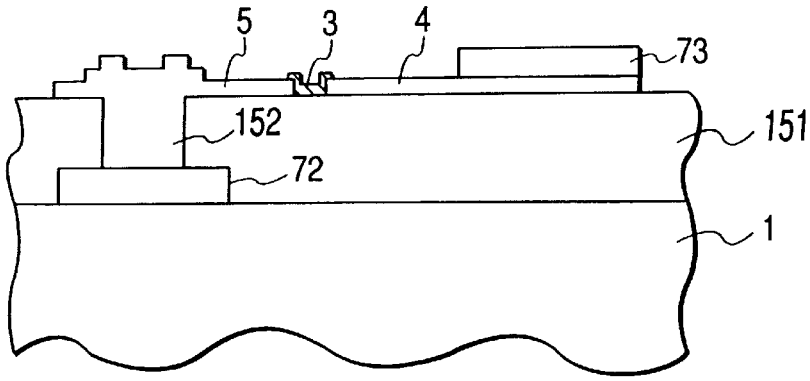
FIG. 14 is a sectional view taken along the line 14—14 in FIG. 13.
Figure 15A:
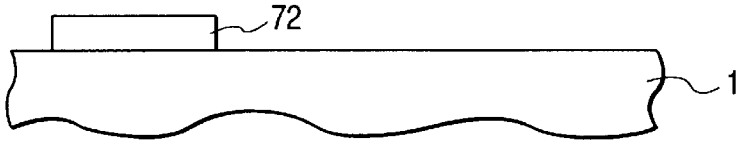
FIGS. 15A, 15B, 15C, and 15D are sectional views, respectively, showing steps in fabricating the electron source substrate.
Figure 15B:
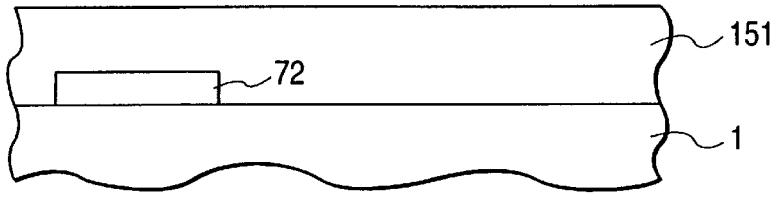
Figure 15C:
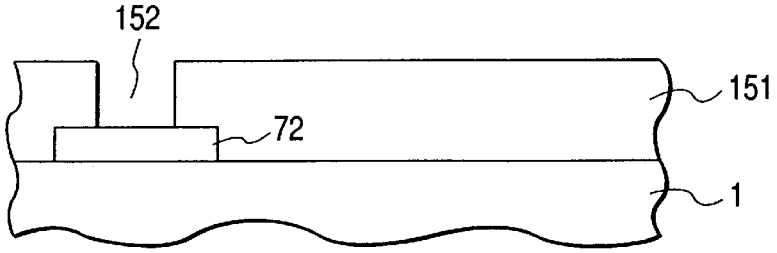
Figure 15D:
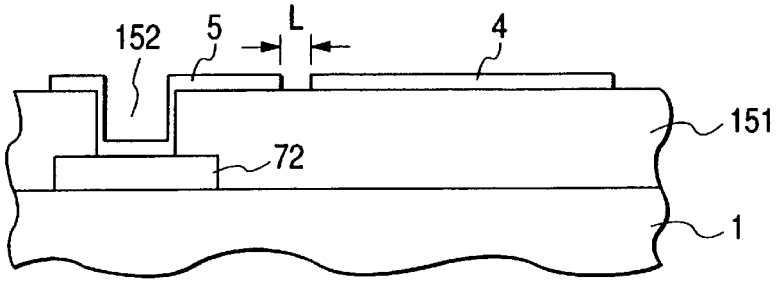
Figure 16E:
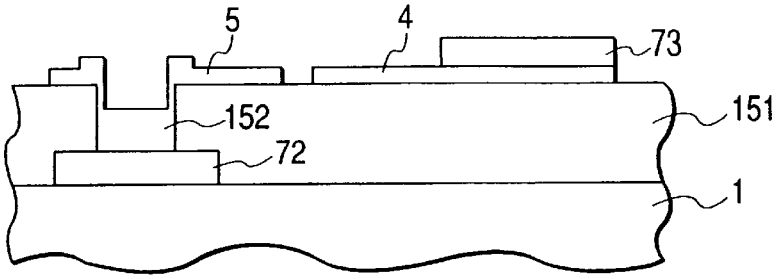
FIGS. 16E, 16F, 16G, and 16H are sectional views, respectively, showing subsequent steps in fabricating the electron source substrate.
Figure 16F:
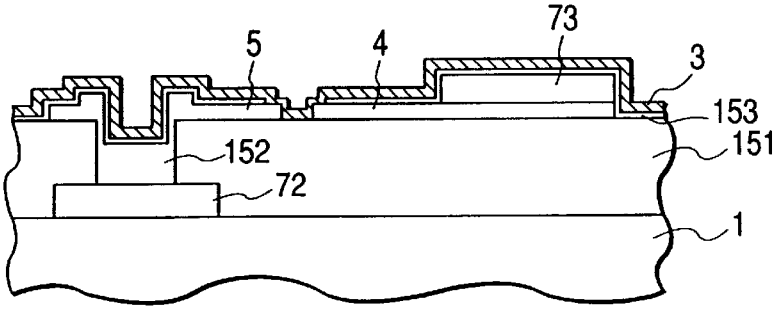
Figure 16G:
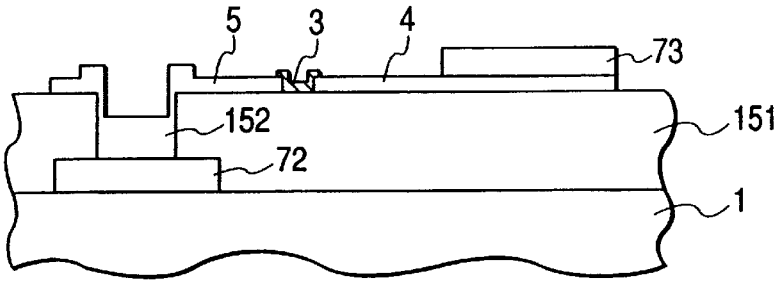
Figure 16H:
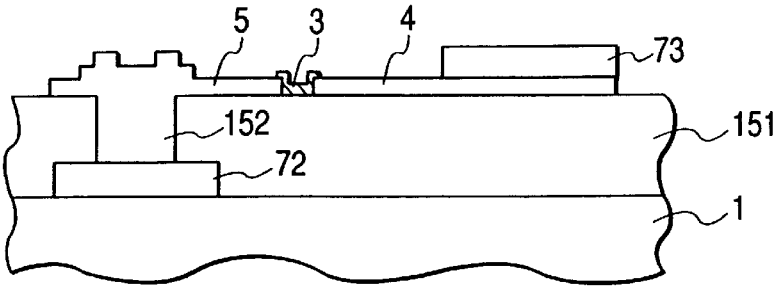

The electron source substrate can be formed by various methods, and an example of the formation methods will be explained with reference to FIGS. 13 and 14. FIG. 13 is a plan view showing part of the electron source substrate. FIG. 14 is a sectional view taken along the line 14—14 in FIG. 13 (in FIGS. 13 and 14, the same reference numerals denote the same parts). In FIGS. 13 and 14, x-direction wiring lines (also referred to as lower wiring lines) 72 corresponding to Dxn in FIG. 7, y-direction wiring lines (also referred to as upper wiring lines) 73 corresponding to Dyn in FIG. 7, a conductive thin film 4, element electrodes 2 and 3, an interlevel insulating layer 151, and a contact hole 112 for electrically connecting the element electrode 2 and each lower wiring line 72 are formed on an electron source substrate 71.

The substrate 1 is satisfactorily cleaned with a detergent, pure water, an organic solvent, or the like, and the lower wiring line 72, interlevel insulating layer 151, upper wiring line 73, and element electrodes 4 and 5 are formed. The wiring lines and electrodes can be formed by vacuum evaporation, sputtering, printing, photolithography, or the like.

The substrate 1 having the wiring lines and element electrodes 4 and 5 is coated with an organic metal solvent to form an organic metal thin film. As the organic metal solvent, an organic metal compound solvent containing a metal of a material for the above-mentioned conductive thin film 3 as a main element can be used. The organic metal thin film is heated, sintered, and patterned into a conductive thin film 3 by lift-off, etching, or the like. Although the coating method of the organic metal solvent has been exemplified, the formation method of the conductive thin film 3 is not limited to this and can be vacuum evaporation, sputtering, chemical vapor deposition, dispersion coating, dipping, spinner, or the like.

2) Formation of Luminescent Display Plate (Face Plate)

A glass substrate 83 is coated with a fluorescent substance with a slurry or the like. A metal back 85 is generally formed on the inner surface of a fluorescent film 84. The metal back can be formed by performing smoothing processing (generally called "filming") on the inner surface of the fluorescent film after formation of the fluorescent film, and depositing Al by vacuum evaporation. In some cases, in the face plate 86, a transparent electrode (not shown) is formed on the outer surface of the fluorescent film 84 in order to improve the conductivity of the fluorescent film 84.

3) Sealing

An envelope like the one shown in FIGS. 8, 9A, and 9B is formed by sealing. The electron source substrate 71, a rear plate 81, and the luminescent display plate 86 are assembled via a support frame 82 and a spacer. A frit glass is applied to the joint portions between the face plate 86, support frame 82, and rear plate 81 and sintered in the atmosphere or nitrogen atmosphere to seal them. For color display, fluorescent substances of respective colors and electron-emitting elements must correspond to each other in sealing and thus are aligned with high precision. By this sealing, a vacuum gauge used in an aging step (to be described below) can be connected to the envelope.

4) Exhaustion

The atmosphere in the complete glass vessel is exhausted by a vacuum pump via an exhaust pipe (not shown).

5) Forming

The obtained element is subjected to a forming step. This forming step can be executed by an electrification method, as described above.

In the complete electron-emitting portion 3, fine particles containing palladium as a main component are dispersed, and the average diameter of the fine particle can be set to, e.g., 30 Å.

6) Activation

The element having undergone forming processing is activated to deposit carbon and a carbon compound at and near the electron-emitting portion. As described above, the activation step is executed by introducing, e.g., an organic substance gas into the envelope and repeatedly applying pulses.

Figure 18A:
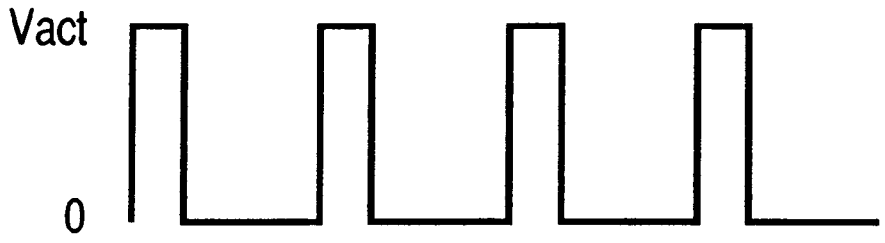
FIGS. 18A and 18B are waveform charts each showing a method of applying a pulse of a given polarity.

The voltage pulse used for activation can take an arbitrary waveform such as a square waveform, triangular waveform, sine waveform, trapezoidal waveform, or the like. The voltage pulse can be applied by a method, FIG. 18A, of always applying pulses of one polarity, or a method, FIG. 18B, of alternately applying pulses of opposite polarities. The peak value (activation voltage Vact) of the voltage pulse can be set by a method using a constant voltage or a method of gradually increasing the voltage with time. The activated surface-conduction type electron-emitting element emits a larger number of electrons than the above electron-emitting portion 3 by applying an element voltage and flowing a current through the element surface.

7) Stabilization

The activated element is desirably subjected to the following stabilization step. This step can also be performed by the above-mentioned method.

8) Sealing/Getter Flash

After stabilization, the exhaust pipe (not shown) is heated and fused by a gas burner to seal the envelope. Getter processing can also be performed to maintain the vacuum degree after sealing the envelope 88. According to this processing, a getter disposed at a predetermined position (not shown) in the envelope 88 is heated by resistance heating, RF heating, or the like, thereby forming a deposition film. The getter generally contains Ba or the like as a main component. The deposition film adsorbs the getter to keep the vacuum degree at, e.g., $1\times10^{-9}$ Torr or less.

9) Aging

After sealing and getter flash, the aging step described in detail above is performed. In this example, aging is done after sealing, but may be done before sealing, in other words, after stabilization.

The complete image display device of the present invention displays an image by respectively applying scan and modulation signals from a signal generation means (not shown) to respective electron-emitting elements via the outer terminals Dx1 to Dxm and Dy1 to Dyn to emit electrons, applying a high voltage Va of several kV or more to the metal back 85 or transparent electrode (not shown) via the high-voltage terminal HV to accelerate the electron beam and collide it against the fluorescent film 84, and exciting the fluorescent film 84 to emit light.

EXAMPLES

The present invention will be described in detail by way of its examples below. However, the present invention is not limited to these examples, and various changes and modifications of respective components can be made within the spirit and scope of the present invention.

Example 1

Example 1 fabricated an image forming device in which many surface-conduction type electron-emitting elements were laid out in a simple matrix on an electron source substrate. The number of elements was 100 in each of the x and y directions. Example 1 adopted a method of appropriately controlling the drive pulse width in the aging step at Va=8 kV as an initial state on the basis of the electron-emitting characteristics of a simulated image forming device identical to the image forming device, and completing the aging around the maximum pulse width (the drive frequency period/the number of scan lines) at Va=8 kV.

1) Formation of Electron Source Substrate

Example 1 formed an electron source substrate like the one shown in FIG. 13. The formation method will be explained in detail in the processing order with reference to FIGS. 15A to 15D and 16E to 16H. In FIGS. 13 to 16H, the same reference numerals denote the same parts. In these drawings, the electron source substrate is 71, x-direction wiring lines (also referred to as lower wiring lines) 72 corresponding to Dxn in FIG. 7, y-direction wiring lines (also referred to as upper wiring lines) 73 corresponding to Dyn in FIG. 7, a conductive thin film 3, element electrodes 4 and 5, an interlevel insulating layer 151, and a contact hole 152 for electrically connecting the element electrode 5 and each lower wiring line 72 are formed on an electron source substrate 71. The following steps a to h respectively correspond to FIGS. 15A to 15D and 16E to 16H. Step-a (Formation of Lower Wiring Line):

A 50-Å thick Cr film and a 6,000-Å thick Au film were stacked on a substrate 1 formed by sputtering a 0.5-μm thick silicon oxide film on a cleaned soda-lime glass. The obtained structure was baked after being spin-coated by a spinner with a photoresist (AZ1370 available from Hoechst). A photomask image was exposed and developed to form a resist pattern for the lower wiring line 72. The Au/Cr deposition film was wet-etched into a lower wiring line 72 with a desired shape.

Step-b (Formation of Interlevel Insulating Layer):

An interlevel insulating film 151 made of a 1.0-μm thick silicon oxide film was RF-sputtered.

Step-c (Formation of Contact Hole):

A photoresist pattern for forming the contact hole 152 was formed on the silicon oxide film deposited in step b, and the interlevel insulating layer 151 was etched using the photoresist pattern as a mask to form a contact hole 152. This etching was RIE (Reactive Ion Etching) using $CF_4$ and $H_2$ gases.

Step-d (Formation of Element Electrode):

A pattern serving as the element electrode 2 and a gap G between element electrodes was formed from a photoresist (RD-2000N-41 available from Hitachi Chemical Co., Ltd.), and a 50-Å thick Ti film and a 1,000-Å thick Ni film were sequentially deposited by vacuum evaporation. The photoresist pattern was dissolved with an organic solvent to lift off the Ni/Ti deposition film, thereby forming element electrodes 4 and 5 having an element electrode interval L of 3 μm and an element electrode width W of 300 μm.

Step-e:

A photoresist pattern for the upper wiring line 73 was formed on the element electrodes 4 and 5, and then a 50-Å thick Ti film and a 5,000-Å thick Au film were sequentially deposited by vacuum evaporation. An unwanted portion was removed by lift-off to form an upper wiring line 73 with a desired shape.

Step-f:

A 100-nm thick Cr film 153 was deposited and patterned by vacuum evaporation. The Cr film 153 was spin-coated by a spinner with an organic Pd film (ccp4230 available from Okuno Seiyaku KK), and heated and sintered at 300° C. for 10 min. A conductive thin film 3 thus formed, which was made of fine particles containing Pd as a main element, had a thickness of 100 Å and a sheet resistance value of 5×104 Ω/□. Note that the fine particle film is one containing a mass of fine particles, as described above. As the fine structure, individual fine particles may be dispersed, be adjacent to each other, or overlap each other (including an island structure). The fine particle has a diameter enough to recognize the particle shape in this state.

Step-g:

The Cr film 153 and the sintered conductive thin film 4 were etched into a desired pattern with an acid etchant.

Step-h:

Such a pattern as to apply a resist to a structure except for the contact hole 152 was formed, and a 50-Å thick Ti film and a 5,000-Å thick Au film were sequentially deposited by vacuum evaporation. An unwanted portion was removed by lift-off to fill the contact hole 152.

By these steps, the lower wiring line 72, interlevel insulating layer 151, upper wiring line 73, element electrodes 4 and 5, conductive thin film 3, and the like were formed on the insulating substrate 01.

2) Formation of Luminescent Display Plate (Face Plate)

For monochrome display, the fluorescent film is made of only the fluorescent substance. In Example 1, the fluorescent substance employed a stripe shape, as shown in FIG. 9A. After black stripes were formed, fluorescent substances of respective colors were applied to the intervals between the stripes to form a fluorescent film. An example of a material for the black stripe was a material containing normal graphite as a main component. A slurry method was used as a method of applying the fluorescent substance to the glass substrate 83. A metal back 85 is generally formed on the fluorescent film 84. The metal back was formed by performing smoothing processing (generally called "filming") on the inner surface of the fluorescent film after formation of the fluorescent film, and depositing Al by vacuum evaporation. In some cases, in the face plate 86, a transparent electrode (not shown) is formed on the outer surface of the fluorescent film 84 in order to improve the conductivity of the fluorescent film 84. This example omitted the transparent electrode because satisfactory conductivity was attained with only the metal back.

3) Sealing

The electron source substrate and luminescent display plate formed in the above way were assembled into an envelope by sealing. The envelope will be explained with reference to FIG. 8. After the electron source substrate 71 was fixed onto a rear plate 81, the face plate 86 was set 5 mm above the substrate 71 via a support frame 82. A frit glass was applied to the joint portions between the face plate 86, support frame 82, and rear plate 81 and sintered in the atmosphere at 410° C. for 10 min to seal them (FIG. 8). The electron source substrate 71 was also fixed to the rear plate 81 with the frit glass. For color display, fluorescent substances of respective colors and electron-emitting elements had to correspond to each other in sealing and thus were aligned with high precision.

4) Exhaustion

The complete envelope was evacuated to a desired vacuum degree by a vacuum pump via an exhaust pipe (not shown).

5) Forming

The voltage was applied to the electrodes 4 and 5 of the electron-emitting element 74 via outer terminals Dxo1 to Doxm and Doy1 to Doyn to perform forming processing for the conductive thin film 3, thereby fabricating the electron-emitting portion 2. FIG. 4B shows the voltage waveform of forming processing.

In FIG. 4B, $T_1$ and $T_2$ respectively represent the pulse width and interval of the voltage waveform. In Example 1, $T_1$ and $T_2$ were respectively set to 1 msec and 10 msec. The peak value of the rectangular wave (peak voltage in forming processing) was increased every step of 0.1 V. Under these conditions, forming processing was performed. The forming voltage was 8.5 V.

6) Activation Step

Figure 18B:
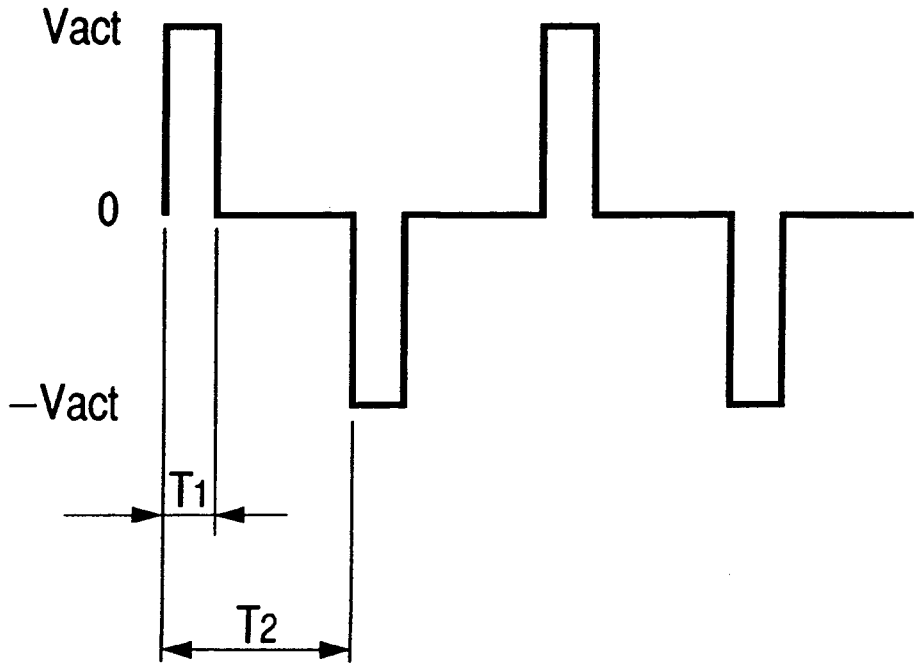

Subsequently, acetone was introduced into the envelope of the vacuum device. While maintaining a vacuum atmosphere of 2 mTorr, square-wave voltage pulses of opposite polarities as shown in FIG. 18B were alternately applied to the electrodes 4 and 5 of the electron-emitting element 74 via the outer terminals Dxo1 to Doxm and Doy1 to Doyn to perform activation for about 30 min. $T_1$ and $T_2$ in FIG. 18B were respectively set to 1 ms and 10 ms, and the activation voltage Vact was set to 17 V.

7) Stabilization

Baking was performed at 200° C. for 5 hrs as stabilization in order to shift the vacuum atmosphere to a high-vacuum atmosphere almost free from any organic substance after activation.

8) Sealing/Getter Flash

The exhaust pipe (not shown) was heated and fused by a gas burner to seal the envelope. Getter processing was performed by RF heating in order to maintain the vacuum degree after sealing.

9) Aging Step

In Example 1, the degassing amount upon driving the image forming device is related to the emission current and drive duty. For this reason, the emission current was measured in advance at, e.g., the anode voltage Va=1 kV, at which the element hardly deteriorated, in a simulated image forming device attached to an ion gauge. Conditions under which an emission gas was not excessively removed when electrons stroke the fluorescent substrate per unit time, that is, the drive pulse width, drive frequency, and the number of drive elements were set to arbitrary steps. Based on them, aging was done.

i) The anode voltage Va and drive voltage were respectively set to 8 kV and 16 V. As a start condition, the number of drive elements was set to 50 lines in the x direction×100 in the y direction, which was half the total number of elements. Driving of the electron source started at a pulse width of 5 μs and a fixed drive frequency of 10 Hz. From this state, the pulse width was increased up to 100 μs at a rate of 1 μs/min.

ii) Aging was performed similarly to i) for the remaining drive elements except for the elements driven first.

iii) Then, driving of all elements started at an anode voltage of 8 kV, a drive frequency of 10 Hz, a drive voltage of 16 V, and a drive pulse width of 100 μs. The increment step of the drive frequency was set to 1 Hz/min, and when the drive frequency had reached 60 Hz, aging ended.

In Example 1, the drive frequency, pulse width, and the number of drive elements were increased under arbitrary conditions. However, the above conditions can be changed in accordance with the panel size and the state of the electron source element, and even if the load increase rate or order is changed, the same effects can be obtained.

Comparative Examples 1 & 1'

Comparative Example 1 fabricated an image forming device by the same process as Example 1 except for the aging step. In Comparative Example 1, driving at 16 V, 60 Hz, and Pw=100 Vs was performed as an aging step at Va=8 kV for 1 hr.

Comparative Example 1' fabricated an image forming device by the same process as Example 1 up to sealing/getter flash without any aging step.

The finished image display device performed full-surface white ON operation at a drive voltage of 16 V and an anode voltage of 6 kV. The Ie average value and Ie variation (ΔIe) of one typical line (100 elements) after 10 min and 5 hrs are as follows:

TABLE 1

| | Ie (μA) After 10 min | ΔIe (%) After 10 min | Ie (μA) After 5 hrs | ΔIe (%) After 5 hrs |
|---|---|---|---|---|
| Example 1 | 400 | 10.0 | 380 | 11.4 |
| Comparative Example 1 | 300 | 20.0 | 250 | 24.0 |
| Comparative Example 1' | 420 | 11.0 | 270 | 21.0 |

From Table 1, the image forming devices of Example 1 and Comparative Example 1' could stably obtain a high-quality (less variations) display image almost free from line and point defects for a long time, compared to Comparative Example 1.

Ten image forming devices according to each of Example 1 and Comparative Examples 1' and 1 were fabricated to find that image defects were generated by discharge in five devices out of 10 devices in Comparative Example 1 but in only one device in Example 1 and Comparative Example 1', and that the fraction defective in Example 1 was lower than in Comparative Example 1'. That is, the image forming device fabrication method of Example 1 exhibited high reliability.

Example 2

Figure 17:
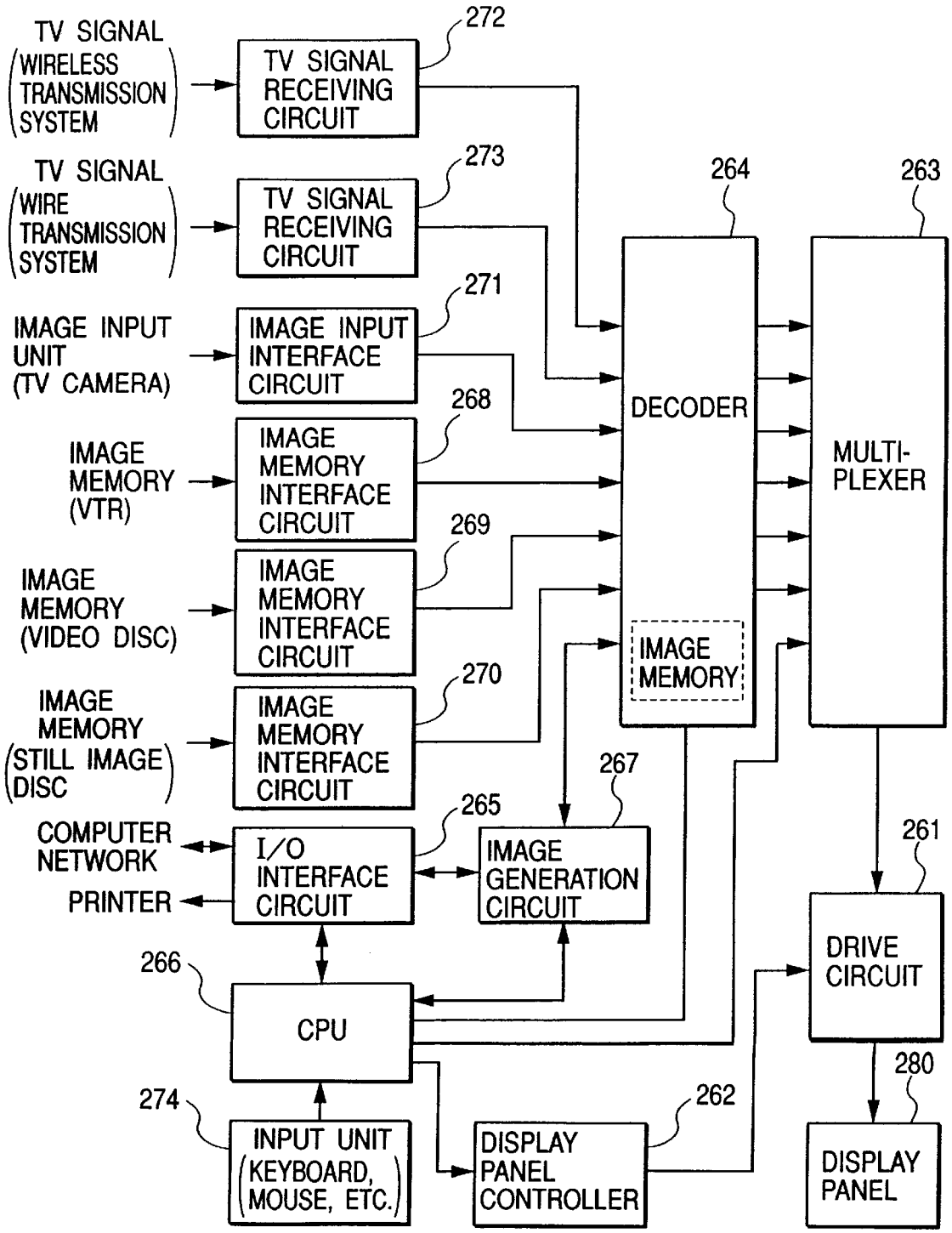
FIG. 17 is a block diagram showing an image forming device in Example 2.

FIG. 17 is a block diagram showing an example of a display device obtained by constituting the image forming device in Example 1 so as to display image information provided from various image information sources such as television broadcasting. In FIG. 17, this display device comprises a display panel 280, a drive circuit 261 for the display panel, a display controller 262, a multiplexer 263, a decoder 264, an I/O interface circuit 265, a CPU 266, an image generation circuit 267, image memory interface circuits 268, 269, and 270, an image input interface circuit 271, TV signal receiving circuits 272 and 273, and an input unit 274. (In this display device, upon reception of a signal containing both video information and audio information such as a television signal, the video information is displayed while the audio information is reproduced. A description of a circuit or a speaker for reception, division, reproduction, processing, storage, or the like of the audio information, which is not directly related to the features of the present invention, will be omitted.)

The TV signal receiving circuit 273 receives a TV image signal transmitted using a radio transmission system such as radio waves or spatial optical communication. The scheme of the TV signal to be received is not particularly limited, and is the NTSC scheme, PAL scheme, SECAM scheme, or the like. A TV signal (e.g., a so-called high-quality TV of the MUSE scheme or the like) made up of a larger number of scan lines serves as a more preferable signal source to take the advantages of the display panel realizing a large area and a large number of pixels. The TV signal received by the TV signal receiving circuit 273 is output to the decoder 264.

The TV image signal receiving circuit 272 receives a TV image signal transmitted using a wire transmission system such as a coaxial cable or optical fiber. The scheme of the TV signal to be received is not particularly limited, as in the TV signal receiving circuit 273. The TV signal received by the circuit 272 is also output to the decoder 264.

The image input interface circuit 271 receives an image signal supplied from an image input device such as a TV camera or image read scanner, and outputs it to the decoder 264.

The image memory interface circuit 270 receives an image signal stored in a video tape recorder (to be briefly referred to as a VTR hereinafter), and outputs it to the decoder 264.

The image memory interface circuit 269 receives an image signal stored in a video disk, and outputs it to the decoder 264.

The image memory interface circuit 268 receives an image signal from a device storing still image data, like a so-called still image disk, and outputs the received still image data to the decoder 264.

The I/O interface circuit 265 connects the display device to an external computer, computer network, or output device such as a printer. The I/O interface circuit 265 allows inputting/outputting image data, character data, and graphic information, and in some cases inputting/outputting a control signal and numerical data between the CPU 266 of the display device and an external device.

The image generation circuit 267 generates display image data on the basis of image data or character/graphic information externally input via the I/O interface circuit 265 or image data or character/graphic information output from the CPU 266. This circuit 267 incorporates circuits necessary to generate images, such as a programmable memory for storing image data and character/graphic information, a read-only memory storing image patterns corresponding to character codes, and a processor for performing image processing.

Display image data generated by the circuit 267 is output to the decoder 264. In some cases, display image data can also be input/output from/to an external computer network or printer via the I/O interface circuit 265.

The CPU 266 mainly performs operation control of the display device and operations about generation, selection, and editing of display images.

For example, the CPU 266 outputs a control signal to the multiplexer 263 to properly select or combine image signals to be displayed on the display panel 280. At this time, the CPU 266 generates a control signal to the display panel controller 262 in accordance with image signals to be displayed, and appropriately controls operation of the display device in terms of the screen display frequency, the scan method (e.g., interlaced or non-interlaced scanning), the number of scan lines for one frame, and the like.

The CPU 266 directly outputs image data or character/graphic information to the image generation circuit 267. In addition, the CPU 266 accesses an external computer or memory via the I/O interface circuit 265 to input image data or character/graphic information.

The CPU 266 may also concern operations for other purposes. For example, the CPU 266 can directly concern the function of generating and processing information, like a personal computer or wordprocessor.

Further, the CPU 266 may be connected to an external computer network via the I/O interface circuit 265 to perform operation such as numerical calculation in cooperation with an external device.

The input unit 274 allows the user to input an instruction, program, or data to the CPU 266. As the input unit 274, various input units such as a joystick, bar code reader, and speech recognition device are available in addition to a keyboard and mouse.

The decoder 264 inversely converts various image signals input from the circuits 267 to 273 into three primary color signals or a luminance signal and I and Q signals. As is indicated by the dotted line in FIG. 17, the decoder 264 desirably incorporates an image memory in order to process a television signal of the MUSE scheme or the like which requires an image memory for inverse conversion. This image memory advantageously facilitates display of a still image, or image processing and editing such as thinning, interpolation, enlargement, reduction, and synthesis of images in cooperation with the image generation circuit 267 and CPU 266.

The multiplexer 263 appropriately selects a display image on the basis of a control signal input from the CPU 266. More specifically, the multiplexer 263 selects a desired one from inversely converted image signals input from the decoder 264, and outputs the selected image signal to the drive circuit 261. In this case, by selectively switching the image signals switched within a 1-frame display time, different images can be displayed in a plurality of areas of one frame, like a so-called multiwindow television.

The display panel controller 262 controls operation of the drive circuit 261 the basis of a control signal input from the CPU 266.

As for the basic operation of the display panel, the display panel controller 262 outputs, e.g., a signal for controlling the operation sequence of a power source (not shown) for driving the display panel to the drive circuit 261.

As for the method of driving the display panel, the display panel controller 262 outputs, e.g., a signal for controlling the screen display frequency or scan method (e.g., interlaced or non-interlaced scanning) to the drive circuit 261.

In some cases, the display panel controller 262 outputs a control signal associated with adjustment of the image quality such as the brightness, contrast, color tone, or sharpness to the drive circuit 261.

The drive circuit 261 generates a drive signal to be supplied to the display panel 280, and operates based on an image signal input from the multiplexer 263 and a control signal input from the display panel controller 262.

The functions of the respective units have been described. The arrangement of the display device shown in FIG. 17 makes it possible to display image information input from various image information sources on the display panel 270. More specifically, various image signals such as television broadcasting signals are inversely converted by the decoder 264, properly selected by the multiplexer 263, and input to the drive circuit 261. On the other hand, the display controller 262 generates a control signal for controlling operation of the drive circuit 261 in accordance with an image signal to be displayed. The drive circuit 261 applies a drive signal to the display panel 280 on the basis of the image and control signals. With this operation, an image is displayed on the display panel 280. A series of operations are systematically controlled by the CPU 266.

This display device can display ones selected from pieces of image information in cooperation with the image memory incorporated in the decoder 264, and the image generation circuit 267 and CPU 266. In addition, the display device can perform, for image information to be displayed, image processing such as enlargement, reduction, rotation, movement, edge emphasis, thinning, interpolation, color conversion, and image aspect ratio conversion, and image editing such as synthesis, erasure, connection, exchange, and pasting. Although not described in Example 2, the display device may comprise an audio circuit for processing and editing audio information, similar to the image processing and the image editing.

The display device can function as a display device for television broadcasting, a terminal device for video conference, an image editing device handling still and dynamic images, a terminal device for computers, an office terminal device such as a wordprocessor, a game device, and the like. This display device are useful for industrial and business purposes, and its application range is very wide.

FIG. 17 merely shows an example of the arrangement of the display device using the image forming device according to the present invention. The application of the image forming device according to the present invention is not limited to this, as a matter of course. For example, among the constituents in FIG. 17, a circuit associated with a function unnecessary for the application purpose can be eliminated. To the contrary, another constituent can be added in accordance with the application purpose. For example, when this display device is used as a television telephone set, transmitting and receiving circuits including a television camera, audio microphone, lighting, and modem are preferably added as constituents.

This display device can easily attain particularly a low-profile display panel using the surface-conduction type electron-emitting element as an electron source, and thus the width of the display device can be decreased. In addition to this, the display panel using the surface-conduction type electron-emitting element as an electron beam source can easily attain a large screen size, high luminance, and excellent view angle characteristics. Accordingly, the display device can display an impressive image with reality and high visibility.

Further, since the electron source exhibits uniform electron-emitting characteristics between surface-conduction type electron-emitting elements, the quality of a formed image is high, and also a high-resolution image can be displayed.

Example 3

Figure 21:
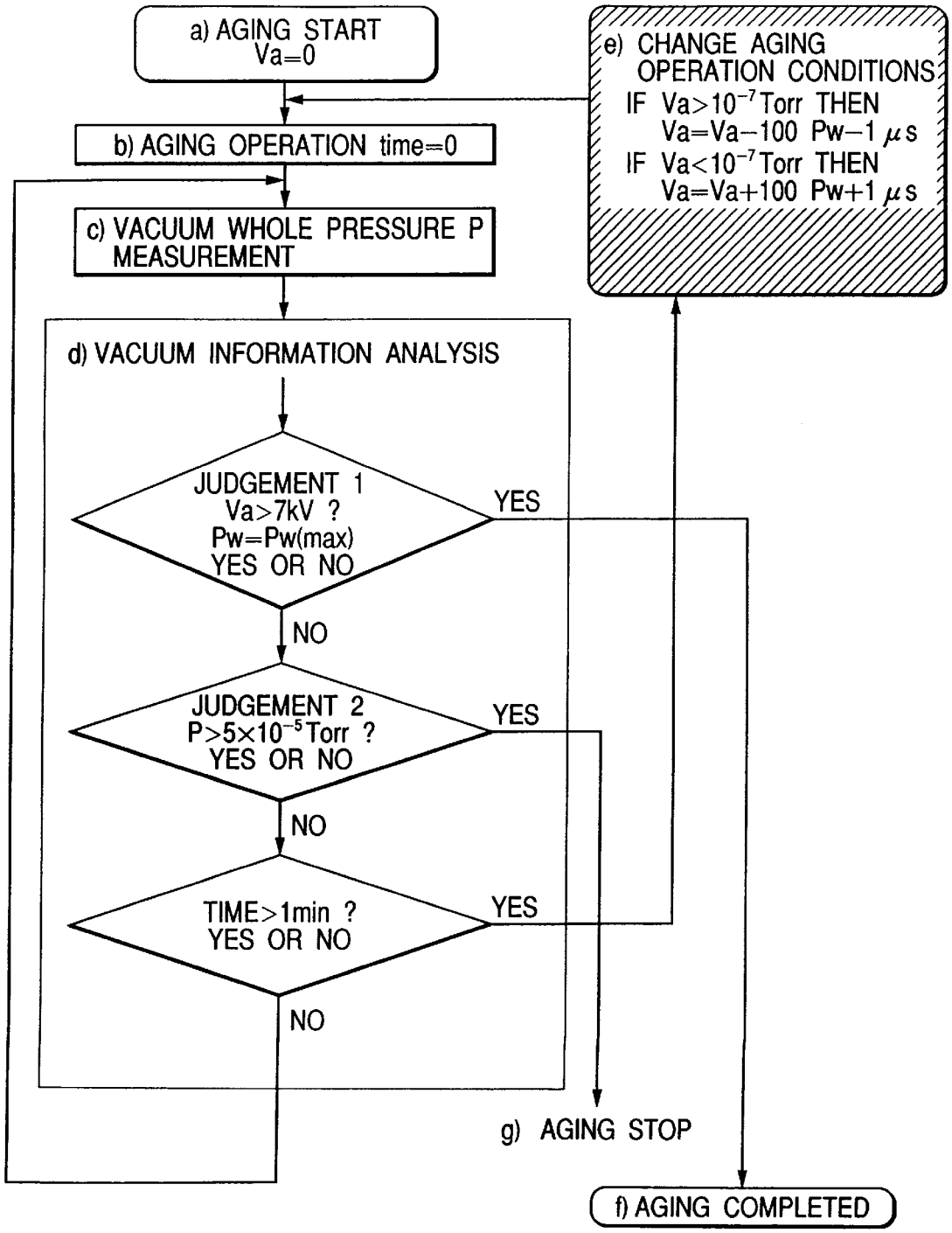
FIG. 21 is a flow chart showing an example of the control method in the aging step of the present invention.

Example 3 fabricated an image forming device following the same procedures as in Example 1 up to sealing. Example 3 employed an aging apparatus as shown in FIG. 19, and a method of feedback-controlling the drive pulse width and anode voltage Va based on a whole pressure measured by an ion gauge connected to the image forming device. FIG. 21 is a flow chart schematically showing a process control method in the aging step of this example.

a) Aging start conditions were the anode voltage Va=0 and 60-Hz scan driving at Vf=16 V.

b) Simultaneously when aging started, c) a whole pressure P (Torr) was measured every minute, and d) & e) the voltage pulse width and anode voltage Va were fed back based on the whole pressure. According to the control logic, when the whole pressure is equal to or lower than a defined whole pressure of $10^{-7}$ Torr, the anode voltage and drive pulse width were respective increased by 500 V and 1 $\mu$s. When the whole pressure is equal to or higher than $10^{-7}$ Torr, the anode voltage and drive pulse width were respective decreased by 500 V and 1 $\mu$s.

Also, this control logic is added with a function g) of urgently stopping aging (Va=0) if the vacuum degree reaches $P<5\times10^{-5}$ Torr (judgement 2). f) The final aging completion criterion (judgement 1) was set to the drive pulse width=100 μs and Va=8 kV. When these conditions are satisfied, aging ended. The aging time was about 1 hr.

As Example 3', an image forming device was fabricated by the same process as Example 1 except for the aging step. In Example 3', the aging step was 60-Hz driving at 16 V with Va=8 kV, and the drive pulse width was increased from 1 to 100 μs at a rate of 0.5 μs/min.

The image forming devices of Examples 3 and 3' could stably obtain a high-quality (less variations) display image almost free from element defects for a long time, compared to Comparative Example 1. Furthermore, the image forming device fabrication method of Example 3 exhibited high reliability.

Example 4

Example 4 fabricated an image forming device following the same procedures as in Example 1 up to the stabilization step. Then, an aging step to be described below, getter flash, and sealing were done. The aging step in Example 4 will be described.

The aging step of Example 4 adopted a method of feedback-controlling the drive voltage Vf based on an $H_2O$ partial pressure measured by a quadruple-pole mass spectrometer connected to the image forming device.

The process control flow in the aging step of this example complies with FIG. 22. Steps a) to g) will be explained.

a) Aging start conditions were Va=6 kV and Vf=10 V.

b) Simultaneously when aging started, c) an $H_2O$ partial pressure $P(H_2O)$ (Torr) with a mass number of 18 was measured every minute, and d) & e) Vf was feedback-controlled based on the $H_2O$ partial pressure in accordance with the following control logic 2. This control logic is given by $$\Delta Vf=-(\log P(H_2O)+8)\times0.2\ [V]$$

$$Vf=Vf+\Delta Vf$$

That is, when the setting voltage is Vf, it is changed to Vf+ΔVf. This control decreases Vf for $P(H_2O)<10^{-8}$ Torr.

Also, this control logic is added with a function g) of urgently stopping aging (Va=0, Vf=0) if the whole pressure reaches $P<5\times10^{-5}$ (judgement 2). The final aging completion criterion (judgement 1) was set to Vf=16 V. When this condition is satisfied, aging ended. The aging time was about 1 hr.

Comparative Example 2

Comparative Example 2 fabricated an image forming device following the same procedures as in Example 4 20 except for the aging step. Comparative Example 2 performed the aging step at Va=6 kV and Vf=16 V for 1 hr.

The finished image display device performed full-surface white ON operation at a drive voltage of 16 V and an anode voltage of 5 kV. The Ie average value and Ie variation (ΔIe) of one typical line (100 elements) after 10 min and 5 hrs are as follows:

TABLE 2

| | Ie (μA) After 10 min | ΔIe (%) After 10 min | Ie (μA) After 5 hrs | ΔIe (%) After 5 hrs |
|---|---|---|---|---|
| Example 4 | 430 | 9.8 | 370 | 12.2 |
| Comparative Example 2 | 420 | 11.0 | 240 | 26.0 |

From Table 2, the image forming device of Example 4 could stably obtain a high-quality (less variations) display image for a long time, compared to Comparative Example 2. Still further, the image forming device fabrication method of Example 4 exhibited high reliability.

Example 5

Example 5 fabricated an image forming device like the one shown in FIG. 12 having an electron source with a ladder-like layout and a grid electrode 120. The number of elements on one row was 10, and a total of 100 elements on 10 rows were laid out.

1) Formation of Electron Source Substrate

Example 5 formed an electron source substrate like the one shown in FIG. 11.

Step-A (Formation of Wiring Line):

A 50-Å thick Cr film and a 6,000-Å thick Au film were stacked on a substrate 1 formed by sputtering a 0.5-μm thick silicon oxide film on a cleaned soda-lime glass. The obtained structure was baked after being spin-coated by a spinner with a photoresist (AZ1370 available from Hoechst). A photomask image was exposed and developed to form a resist pattern for the wiring line. The Au/Cr deposition film was wet-etched into a wiring line with a desired shape.

Step-B (Formation of Element Electrode):

A pattern serving as an element electrode 2 and a gap G between element electrodes was formed from a photoresist (RD-2000N-41 available from Hitachi Chemical Co., Ltd.), and a 50-Å thick Ti film and a 1,000-Å thick Ni film were sequentially deposited by vacuum evaporation. The photoresist pattern was dissolved with an organic solvent to lift off the Ni/Ti deposition film, thereby forming element electrodes 2 and 3 having an element electrode interval L of 3 μm and an element electrode width W of 300 μm.

Step-C:

A 100-nm thick Cr film 153 was deposited and patterned by vacuum evaporation. The Cr film 153 was spin-coated by a spinner with an organic Pd film (ccp4230 available from Okuno Seiyaku KK), and heated and sintered at 300° C. for 10 min. A conductive thin film 4 thus formed, which was made of fine particles containing Pd as a main element, had a thickness of 100 Å and a sheet resistance value of $5\times10^4$ Ω/□. Note that the fine particle film is one containing a mass of fine particles, as described above. As the fine structure, individual fine particles may be dispersed, be adjacent to each other, or overlap each other (including an island structure). The fine particle has a diameter enough to recognize the particle shape in this state.

Step-D:

The Cr film 153 and the sintered conductive thin film 4 were etched into a desired pattern with an acid etchant.

2) Formation of Luminescent Display Plate (Face Plate)

A luminescent display plate was formed following the same procedures as in Example 1.

3) Sealing

The electron source substrate and luminescent display plate formed in the above way were assembled into an envelope like the one shown in FIG. 12 by sealing. A grid was set 1 mm above the electron source substrate, and the face plate was set 5 mm above the substrate via a support frame. A frit glass was applied to the joint portions and sintered in the atmosphere at 410° C. for 10 min to seal the grid, face plate, and support frame. Fluorescent substances of respective colors and electron-emitting elements had to correspond to each other and thus were aligned with high precision.

The process subsequent to 4) exhaustion was the same as Example 1 up to 8) sealing/getter step.

The aging step of Example 5 adopted a method of feedback-controlling the grid and anode voltages Vg and Va based on an $O_2$ partial pressure measured by a quadruple-pole mass spectrometer connected to the image forming device. The process control flow in the aging step of this example complies with FIG. 22. Steps a) to g) will be explained.

a) Aging start conditions were Va=0 kV, Vf=15 V, and Vg=0 V.

b) Simultaneously when aging started, c) an $O_2$ partial pressure $P(O_2)$ (Torr) with a mass number of 32 was measured every minute, and d) & e) Vg was feedback-controlled based on the $O_2$ partial pressure. This control logic is given by $$\Delta Vg=-(\log P(O_2)+9)\times 2\ [V]$$

$$Vg=Vg+\Delta Vg$$

$$\Delta Va=-(\log P(O_2)+9)\times 200\ [V]$$

$$Vg=Vg+\Delta Vg$$

This control increases Vg and Va for $P(O_2)<10^{-9}$ Torr, and decreases them for $P(O_2)<10^{-9}$ Torr. Also, this control logic is added with a function g) of urgently stopping aging (Vg=0, Va=0) if the whole pressure reaches $P<5\times10^{-5}$ (judgement 2). The final aging completion criterion (judgement 1) was set to Vg=50 V and Va=5 kV. When these conditions are satisfied, aging ended. The aging time was about 50 min.

Comparative Example 3

Comparative Example 3 fabricated an image forming device by the same process as Example 5 except for the aging step. Comparative Example 3 did not perform the aging step.

The complete image display device performed entire-surface white ON operation at a drive voltage of 15 V, an anode voltage of 5 kV, and a grid voltage of 50 V. The Ie average value and Ie variation (ΔIe) of one typical line (100 elements) after 10 min and 5 hrs are as follows:

TABLE 3

| | Ie (μA) After 10 min | ΔIe (%) After 10 min | Ie (μA) After 5 hrs | ΔIe (%) After 5 hrs |
|---|---|---|---|---|
| Example 5 | 500 | 10.0 | 410 | 12.8 |
| Comparative Example 3 | 520 | 10.6 | 300 | 21.0 |

From Table 3, the image forming device of Example 5 could stably obtain a high-quality (less variations) display image for a long time, compared to Comparative Example 3. Moreover, the image forming device fabrication method of Example 5 exhibited high reliability.

Example 6

Example 6 fabricated an image forming device following the same procedures as in Example 1 up to 8) sealing/getter step. The aging step of Example 6 adopted multi-control of feeding the whole pressure back to the scan frequency, feeding back the drive voltage by the electron source drive power, and feeding back the anode voltage by the luminescent display power. The process control flow in the aging step of this example complies with FIG. 21. Steps a) to g) will be explained.

a) Aging start conditions were Va=0 kV, Vf=10 V, and the scan frequency SF=1 Hz.

b) Simultaneously when aging started, c) a whole pressure P (Torr), electron source drive current, and luminescent display current were measured every minute, and d) & e) Va, Vf, and SF were feedback-controlled based on these results. This control logic is given by $$\Delta Va=-(\text{luminescent display power}-0.1\times t)\times 100\ [V]$$

$$Va=Va+\Delta Va$$

$$\Delta Vf=-(\text{electron source drive power}-0.1\times t)\times 0.2\ [V]$$

$$Va=Va+\Delta Va$$

$$\Delta SF=-(\log P+7)\times 0.5\ [Hz]$$

$$SF=SF+\Delta SF$$

The luminescent display power means power which is calculated by luminescent display current×anode voltage and applied to the luminescent display plate. The electron source drive power means power which is calculated by electron source drive current×drive voltage and applied to the electron source substrate. t is a time [min] from the start of aging. Va, Vf, and SF are respectively controlled within the range from 0 to 6 kV, the range from 10 to 16 V, and the range from 1 to 60 Hz. This control increases the luminescent display power and electron source drive current at a rate of 0.1 W/min. The scan frequency is controlled on the basis of a whole pressure of $10^{-7}$ Torr. This control logic is added with a function g) of urgently stopping aging (Vg=0, Vf=0) if the whole pressure reaches $P<5\times10^{-5}$ or the luminescent display power reaches 20 W or more (judgement 2). The final aging completion criterion (judgement 1) was set to Va=6 kV, Vf=16 V, and SF=60 Hz. When these conditions are satisfied, aging ended.

The image forming device of Example 6 was TV-driven to stably obtain a higher-quality display image than Comparative Example 1. In addition, the image forming device fabrication method of Example 6 exhibited high reliability.

Example 7

Example 7 fabricated an image forming device following the same procedures as in Example 1 up to 8) sealing/getter step. The aging step of Example 7 done a series of control operations: the first sequence of feedback-controlling the scan frequency by the whole pressure and the second sequence of feedback-controlling the drive pulse width by the whole pressure upon completion of the first sequence. The process control flow of each sequence complies with FIG. 20.

As the first sequence, a) Aging start conditions were the anode voltage Va=8 kV, Vf=16 V, and SF=1 Hz.

b) Simultaneously when aging started, c) a whole pressure P (Torr) was measured every minute, and d) & e) the scan frequency SF was feedback-controlled based on this result. This control logic is given by $$\Delta SF=-(\log P+7)\times 0.5\ [\mathrm{Hz}]$$

$$SF=SF+\Delta SF$$

The first sequence completion criterion (judgement 1) was set to SF=60 Hz. If this condition was satisfied, the flow advanced to the second sequence.

As the second sequence, a) Aging start conditions were the anode voltage Va=8 kV, Vf=16 V, the drive pulse=1 u$\mu$, and the electron source scan frequency=60 Hz.

b) Simultaneously when aging started, c) a whole pressure P (Torr) was measured every minute, and d) & e) the drive pulse was feedback-controlled based on this result. This control logic is given by $$\Delta Pw=-(\log P+7)\times 0.5\ [\mu s]$$

$$Pw=Pw+\Delta Pw$$

The second sequence completion criterion (judgement 1) was set to Pw=30 $\mu$s. The series of sequences are added with a function g) of urgently stopping aging (Va=0, Vf=0) if the whole pressure reaches $P<5\times10^{-5}$ (judgement 2).

The image forming device of Example 7 was TV-driven to stably obtain a higher-quality display image than Comparative Example 2. Further, the image forming device fabrication method of Example 7 exhibited high reliability.

Example 8

Example 8 fabricated an image forming device following the same procedures as in Example 1 up to 8) sealing/getter step. The aging step of Example 8 done a series of control operations: the first sequence of feedback-controlling the scan frequency by the whole pressure and the second sequence of feedback-controlling the anode voltage by the whole pressure upon completion of the first sequence. The process control flow of each sequence complies with FIG. 20.

As the first sequence, a) Aging start conditions were the anode voltage Va=1 kV, Vf=16 V, and SF=1 Hz.

b) Simultaneously when aging started, c) a whole pressure P (Torr) was measured every minute, and d) & e) the scan frequency SF was feedback-controlled based on this result. This control logic is given by $$\Delta SF=-(\log P+7)\times 0.5\ [\mathrm{Hz}]$$

$$SF=SF+\Delta SF$$

The first sequence completion criterion (judgement 1) was set to SF=60 Hz. If this condition was satisfied, the flow advanced to the second sequence.

As the second sequence, a) Aging start conditions were the anode voltage Va=1 kV and Vf=16 V, and an electron source scan condition was 60-Hz scanning.

b) Simultaneously when aging started, c) a whole pressure P (Torr) was measured every minute, and d) & e) Va was feedback-controlled based on this result. This control logic is given by $$\Delta Va=-(\log P+7)\times 0.5\ [\mu s]$$

$$Va=Va+\Delta Va$$

The second sequence completion criterion (judgement 1) was set to Va=7 kV. After the second sequence, the image forming device was driven at Va=6 kV, Vf=16 V, and SF=60 Hz for 10 min to end the aging step. The series of sequences are added with a function g) of urgently stopping aging (Va=0, Vf=0) if the whole pressure reaches $P<5\times10^{-5}$ (judgement 2).

The image forming device of Example 8 was TV-driven to stably obtain a higher-quality display image than Comparative Example 1. The image forming device fabrication method of Example 8 exhibited high reliability.

The aging step allows the image forming device of the present invention to suppress element deterioration along with elimination of gas molecules from panel constituents, suppress generation of point and line defects and the like, and increase the yield. Since deterioration in the initial stage of operation can be suppressed, a high-luminance image forming device capable of stable display can be realized.

The present invention can achieve the above effects without especially performing any vacuum baking process at high temperatures.

What is claimed is:

1. A method of fabricating an image forming device having an electron source substrate, a plurality of electron-emitting elements disposed on the electron source substrate, and a luminescent display plate separated from the electron source substrate by a vacuum portion, the method comprising the steps of:

selectively exhausting or maintaining a vacuum state of the vacuum portion, using a getter;

applying signals to selected ones of the electron-emitting elements; and controllably varying at least one characteristic of the signals applied to the selected electron-emitting elements, while selectively exhausting or maintaining the vacuum state of the vacuum portion, so as to cause an aging condition in the image forming device, wherein the step of controllably varying the at least one characteristic of the signals is performed by gradually increasing a pulse width of each signal up to a predetermined maximum drive pulse width, over a predetermined time period, while maintained a frequency of the signal substantially constant.

2. A method of fabricating an image forming device having an electron source substrate, a plurality of electron-emitting elements disposed on the electron source substrate, and a luminescent display plate separated from the electron source substrate by a vacuum portion, the method comprising the steps of:

selectively exhausting or maintaining a vacuum state of the vacuum portion, using a getter;

applying signals to selected ones of the electron-emitting elements; and controllably varying at least one characteristic of the signals applied to the selected electron-emitting elements, while selectively exhausting or maintaining the vacuum state of the vacuum portion, so as to cause an aging condition in the image forming device, wherein the step of controllably varying the at least one characteristic of the signals is performed by gradually increasing a frequency of each signal over a predetermined time period, while maintained a pulse width of the signal substantially constant.

3. A method of fabricating an image forming device having an electron source substrate, a plurality of electron-emitting elements disposed on the electron source substrate, and a luminescent display plate separated from the electron source substrate by a vacuum portion, the method comprising the steps of:

selectively exhausting or maintaining a vacuum state of the vacuum portion, using a getter;

applying signals to selected ones of the electron-emitting elements, while selectively exhausting or maintaining the vacuum state of the vacuum portion; and controllably varying the number of electron-emitting elements to which the signals are applied, over a predetermined time period, so as to cause an aging condition in the image forming device, wherein the controllably varying step is performed by applying the signals to an increased number of the electron-emitting devices.

4. An image forming device fabrication method according to any one of claims 1 to 3, further comprising a step of detecting a condition in the vacuum portion, using a vacuum gauge, and wherein the controllably varying step is performed based on the detected condition in the vacuum portion.

5. An image forming device fabrication method according to claim 4, wherein the controllably varying step is performed based on a whole pressure of the vacuum portion detected by the vacuum gauge, and includes a first control scheme of increasing at least one of a pulse width of each signal, a voltage of each signal, a frequency of each signal, the number of electron-emitting elements to which the signals are applied, and an anode voltage applied to the luminescent display plate, when the whole pressure is equal to or lower than a predefined whole pressure, and a second control scheme of decreasing or maintaining at least one of the pulse width of each signal, the voltage of each signal, the frequency of each signal, the number of electron-emitting elements to which the signals are applied, and the anode voltage, when the whole pressure is equal to or higher than the predefined whole pressure.

6. An image forming device fabrication method according to claim 5, wherein the predefined whole pressure is not more than $10^{-6}$ Torr.

7. An image forming device fabrication method according to claim 5, wherein the predefined whole pressure is not more than $10^{-8}$ Torr.

8. An image forming device fabrication method according to claim 4, wherein the controllably varying step is performed based on an amount of $H_2O$ partial pressure, detected by the vacuum gauge, in the vacuum portion, and includes a first control scheme of increasing at least one of a pulse width of each signal, a voltage of each signal, a frequency of each signal, the number of electron-emitting elements to which the signals are applied, and an anode voltage applied to the luminescent display plate, when the $H_2O$ partial pressure is not more than a predefined $H_2O$ partial pressure, and a second control scheme of decreasing or maintaining at least one of the pulse width of each signal, the voltage of each signal, the frequency of each signal, the number of electron-emittinq elements to which the signals are applied, and the anode voltage, when the $H_2O$ partial pressure is not less than the predefined $H_2O$ partial pressure.

9. An image forming device fabrication method according to claim 8, wherein the predefined $H_2O$ partial pressure is not more than $10^{-7}$ Torr.

10. An image forming device fabrication method according to claim 8, wherein the predefined $H_2O$ partial pressure is not more than $10^{-11}$ Torr.

11. An image forming device fabrication method according to claim 4, wherein the controllably varying step is performed based on an amount of $O_2$ partial pressure, detected by the vacuum gauge, in the vacuum portion, and includes a first control scheme of increasing at least one of a pulse width of each signal, a voltage of each signal, a frequency of each signal, the number of electron-emitting elements to which the signals are applied, and an anode voltage applied to the luminescent display plate, when the $O_2$ partial pressure is not more than a predefined $O_2$ partial pressure, and a second control scheme of decreasing or maintaining at least one of the pulse width of each signal, the voltage of each signal, the frequency of each signal, the number of electron-emitting elements to which the signals are applied, and the anode voltage, when the $O_2$ partial pressure is not less than the predefined $O_2$ partial pressure.

12. An image forming device fabrication method according to claim 11, wherein the predefined $O_2$ partial pressure is not more than $10^{-7}$ Torr.

13. An image forming device fabrication method according to claim 11, wherein the predefined $O_2$ partial pressure is not more than $10^{-10}$ Torr.

14. An image forming device fabrication method according to any one of claims 1 to 3, wherein, prior to the controllably varying step, further steps are performed of:

forming each electron-emitting element;

activating each electron-emitting element; and stabilizing each electron-emitting element.

15. An image forming device fabrication method according to claim 14, wherein the electron-emitting elements are arranged in a ladder-like layouts and wherein the image forming device also comprises a control electrode for controlling an electron beam emitted by each electron-emitting element in accordance with an information signal.

16. An image forming device fabrication method according to claim 14, wherein the electron-emitting elements are arranged in a matrix layout.

* * * * *

UNITED STATES PATENT AND TRADEMARK OFFICE

CERTIFICATE OF CORRECTION

PATENT NO. : 6,149,480
DATED : November 21, 2000
INVENTOR(S) : Tatsuya Iwasaki et al.

It is certified that error appears in the above-identified patent and that said Letters Patent is hereby corrected as shown below:

Column 1,
Line 58, "replacing" should read -- replaced --.

Column 9,
Line 52, "107" should read -- $10^7$ --.

Column 11,
Line 55, "p. 195) In" should read -- p. 195). ¶ In --.

Column 12,
Line 5, "reference)" should read -- reference). --.

Column 18,
Line 66, "Si" should read -- S1 --.

Column 19,
Line 3, "Si" should read -- S1 --.

Column 24,
Line 24, "16H. Step-a" should read -- 16H. ¶ Step-a --;
Line 51, "lift off" should read -- lift-off --.

Column 25,
Line 2, "5x104" should read -- $5x10^4$ --.

Column 26,
Line 66, "Vs" should read -- $\mu$s --.

Column 30,
Line 13, "are" should read -- is --;
Line 64, "respective" should read -- respectively --.

Column 31,
Line 59, "20" should be deleted.

UNITED STATES PATENT AND TRADEMARK OFFICE

CERTIFICATE OF CORRECTION

PATENT NO. : 6,149,480
DATED : November 21, 2000
INVENTOR(S) : Tatsuya Iwasaki et al.

It is certified that error appears in the above-identified patent and that said Letters Patent is hereby corrected as shown below:

Column 34,
Line 55, "done" should read -- did --.

Column 35,
Line 12, "uμ," should read -- μs, --;
Line 35, "done" should read -- did --.

Column 36,
Lnie 42, "maintained" should read -- maintaining --;
Line 63, "maintained" should read -- maintaining --;

Column 38,
Line 50, "layouts" should read -- layout, --.

Signed and Sealed this

Twenty-fifth Day of December, 2001

*Attest:*

*Attesting Officer*

JAMES E. ROGAN
*Director of the United States Patent and Trademark Office*